US007891996B2

(12) United States Patent
Aoki et al.

(10) Patent No.: US 7,891,996 B2
(45) Date of Patent: Feb. 22, 2011

(54) OBJECT FITTING/REMOVING DRIVE UNIT, AND CONNECTOR UNIT

(75) Inventors: Shigeharu Aoki, Tokyo (JP); Masahiro Yamauchi, Tokyo (JP)

(73) Assignees: Japan Aviation Electronics Industry Limited, Tokyo (JP); NEC Corporation, Tokyo (JP)

( * ) Notice: Subject to any disclaimer, the term of this patent is extended or adjusted under 35 U.S.C. 154(b) by 0 days.

(21) Appl. No.: 12/482,705

(22) Filed: Jun. 11, 2009

(65) Prior Publication Data

US 2009/0317991 A1 Dec. 24, 2009

(30) Foreign Application Priority Data

Jun. 20, 2008 (JP) ..... 2008-162256

(51) Int. Cl.
*H01R 13/62* (2006.01)

(52) U.S. Cl. ..... 439/157

(58) Field of Classification Search ..... 439/157, 439/372

See application file for complete search history.

(56) References Cited

U.S. PATENT DOCUMENTS 7,513,784 B2 * 4/2009 Shibata ..... 439/157
7,559,778 B2 * 7/2009 Pittenger et al. ..... 439/157

FOREIGN PATENT DOCUMENTS

JP 2002-313521 A 10/2002

* cited by examiner

*Primary Examiner*—Gary F. Paumen
(74) *Attorney, Agent, or Firm*—Holtz, Holtz, Goodman & Chick, PC

(57) ABSTRACT

An object fitting/removing drive unit which is capable of enhancing accuracy of positioning and fitting of objects to be connected. To determine a position of a header connector on an imaginary plane which is orthogonal to a fitting/removing direction of a cable connector, cutouts which are fitted in flanges to position the flanges are formed in an inner frame.

12 Claims, 26 Drawing Sheets

OBJECT FITTING/REMOVING DRIVE UNIT, AND CONNECTOR UNIT

BACKGROUND OF THE INVENTION

1. Field of the Invention

This invention relates to an object fitting/removing drive unit for fitting and removing objects to be connected to and from each other.

2. Description of the Related Art

Conventionally, there has been proposed a connector drive unit for fitting and removing connectors to and from each other (see Japanese Laid-Open Patent Publication (Kokai) No. 2002-313521).

This connector drive unit is comprised of operation frames each holding one connector, an operation frame-accommodating body which slidably accommodates the operation frames, sliders which drive the operation frames, and locks which restrict sliding of the operation frames.

Each operation frame includes connector holding portions, driven portions, and engaging portions engaged with associated one of the locks.

Each slider includes a lock-moving cam groove for moving the locks, and an operation frame-driving cam groove for driving the driven portions.

In this connector drive unit, it is possible to fit and remove the connectors which are disposed opposed to each other by sliding the sliders.

In the above-described connector drive unit, in fitting the connectors to each other, the connectors are positioned via the panel of a casing, and hence there is a problem that the accuracy of fitting the connectors is low.

SUMMARY OF THE INVENTION

The present invention has been made in view of these circumstances, and an object thereof is to provide an object fitting/removing drive unit and a connector drive unit which are capable of enhancing the accuracy of fitting objects to be connected to each other, in a direction which is orthogonal to a fitting/removing direction.

To attain the above object, in a first aspect of the present invention, there is provided an object fitting/removing drive unit for fitting and removing one object to be connected and another object to be connected to and from each other, comprising at least one operation member that has a holding frame which holds the one object to be connected, an inner frame that accommodates the operation member in a manner movable in a fitting/removing direction, the inner frame being formed with a first positioning portion which determines a position of the other object to be connected, on an imaginary plane which is orthogonal to the fitting/removing direction, with respect to the one object to be connected, an outer frame that is mounted on the inner frame in a manner movable along a direction which is orthogonal to the fitting/removing direction between an initial position and a fitting-completed position, for guiding the operation member toward the other object to be connected to fit the one object to be connected to the other object to be connected, when the outer frame is moved from the initial position to the fitting-completed position, driving force-transferring means for transferring a driving force in the direction which is orthogonal to the fitting/removing direction, to the outer frame, and a flange that is connected to the other object to be connected, and is fitted to the inner frame.

With the arrangement of the object fitting/removing drive unit according to the first aspect of the present invention, the inner frame has the first positioning portion formed therein which determines the position of the other object to be connected on an imaginary plane which is orthogonal to the fitting/removing direction with respect to the one object to be connected. Therefore, it is possible to determine the position of the objects to be connected without a panel.

Preferably, the first positioning portion is a cutout for positioning.

Preferably, the outer frame is formed with a second positioning portion which determines a position of the other object to be connected in the fitting/removing direction with respect to the one object to be connected.

More preferably, the second positioning portion is formed by a positioning groove which is formed in the outer frame, and extends in the direction which is orthogonal to the fitting/removing direction, and guiding cutouts which are formed in the inner frame and the outer frame, respectively, for guiding a protrusion which is provided on the flange to the positioning groove.

To attain the above object, in a second aspect of the present invention, there is provided a connector unit having one connector, another connector which is capable of being fitted to the one connector, and an object fitting/removing drive unit for fitting/removing both the connectors comprising at least one operation member that has a holding frame which holds the one connector, an inner frame that accommodates the operation member in a manner movable in a fitting/removing direction, the inner frame being formed with a first positioning portion which determines a position of the other connector, on an imaginary plane which is orthogonal to the fitting/removing direction, with respect to the one connector, an outer frame that is mounted on the inner frame in a manner movable along a direction which is orthogonal to the fitting/removing direction between an initial position and a fitting-completed position, for guiding the operation member toward the other connector to fit the one connector to the other connector, when the outer frame is moved from the initial position to the fitting-completed position, driving force-transferring means for transferring a driving force in the direction which is orthogonal to the fitting/removing direction, to the outer frame, and a flange that is connected to the other object to be connected, and is fitted to the inner frame Preferably, the first positioning portion is a cutout for positioning.

Preferably, the outer frame is formed with a second positioning portion which determines a position of the other object to be connected in the fitting/removing direction with respect to the one object to be connected.

More preferably, the second positioning portion is formed by a positioning groove which is formed in the outer frame, and extends in the direction which is orthogonal to the fitting/removing direction, and guiding cutouts which are formed in the inner frame and the outer frame, respectively, for guiding a protrusion which is provided on the flange to the positioning groove.

According to the present invention, it is possible to enhance accuracy of fitting the objects to be connected in each other in the direction which is orthogonal to the fitting/removing direction.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 7:
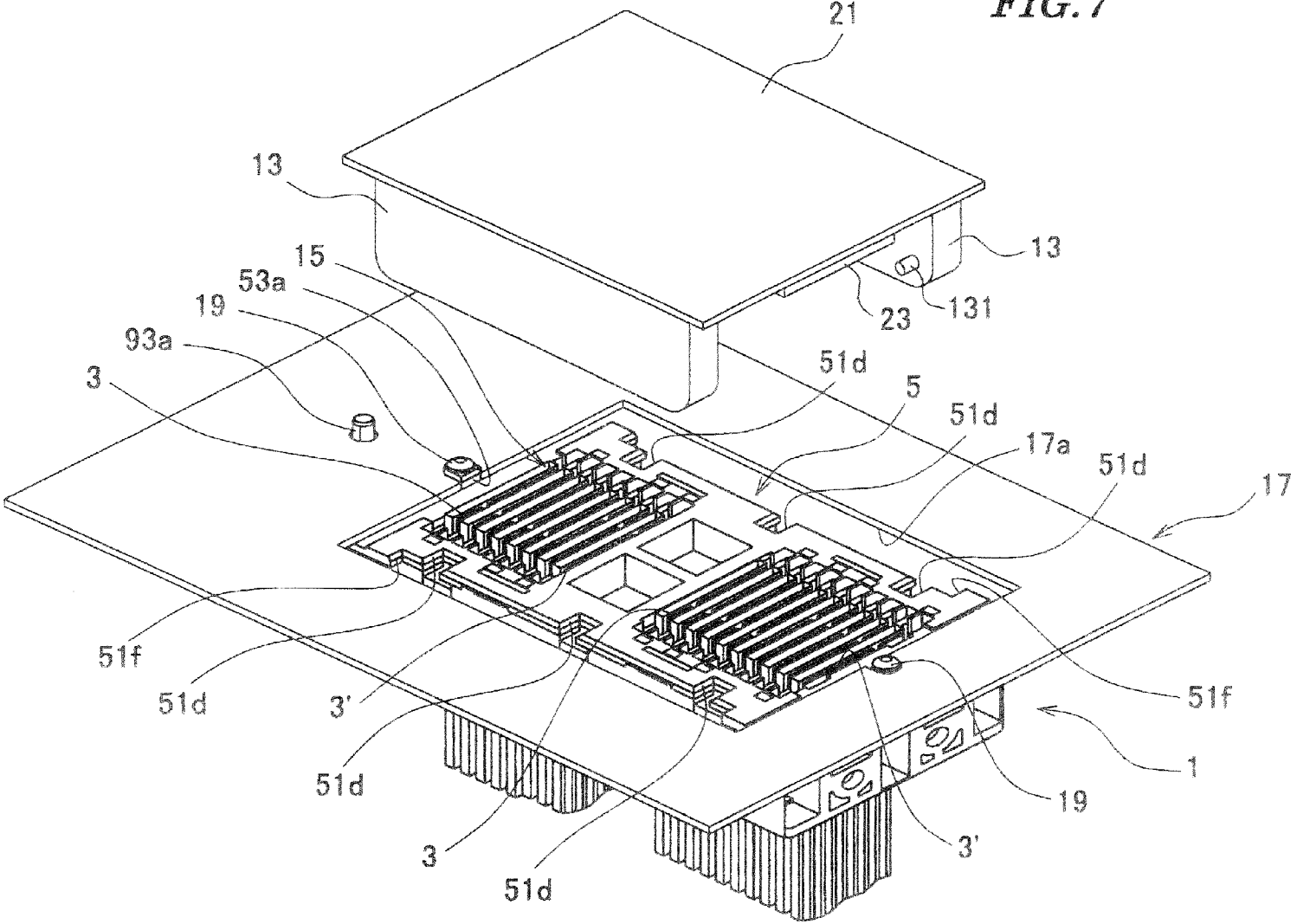
FIG. 7 is a perspective view of the object fitting/removing drive unit shown in FIG. 1 in a state before fitting an inner frame and a flange which is fixed on a substrate.
Figure 8A:
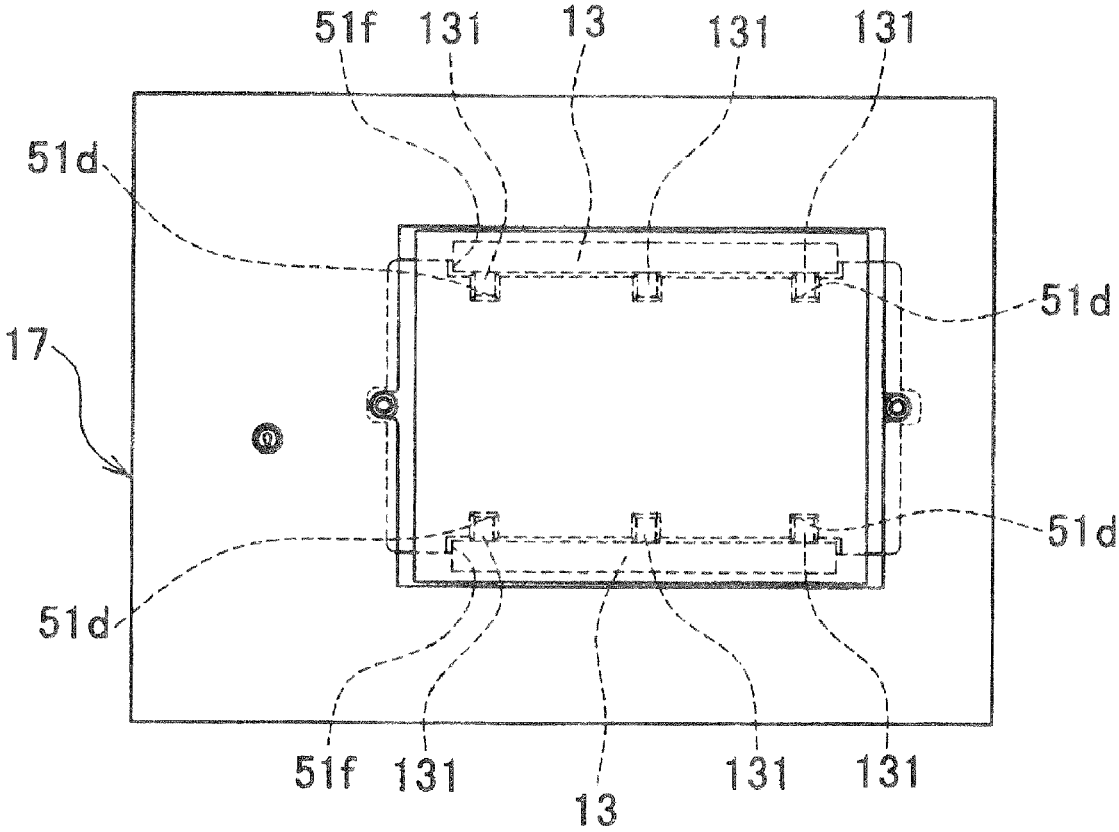
FIG. 8A is a plan view of the object fitting/removing drive unit shown in FIG. 1 in a state of use.
Figure 8B:
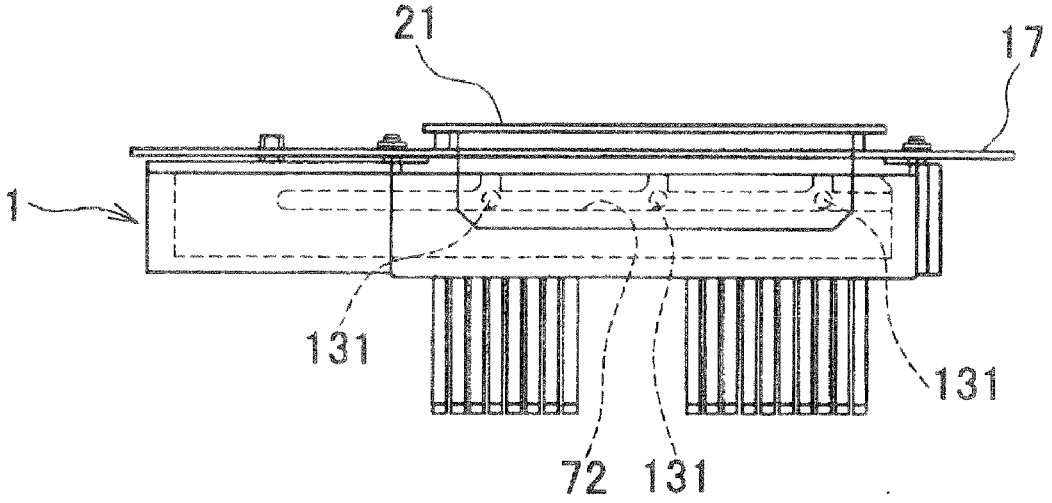
FIG. 8B is a front view of the same.
Figure 8C:
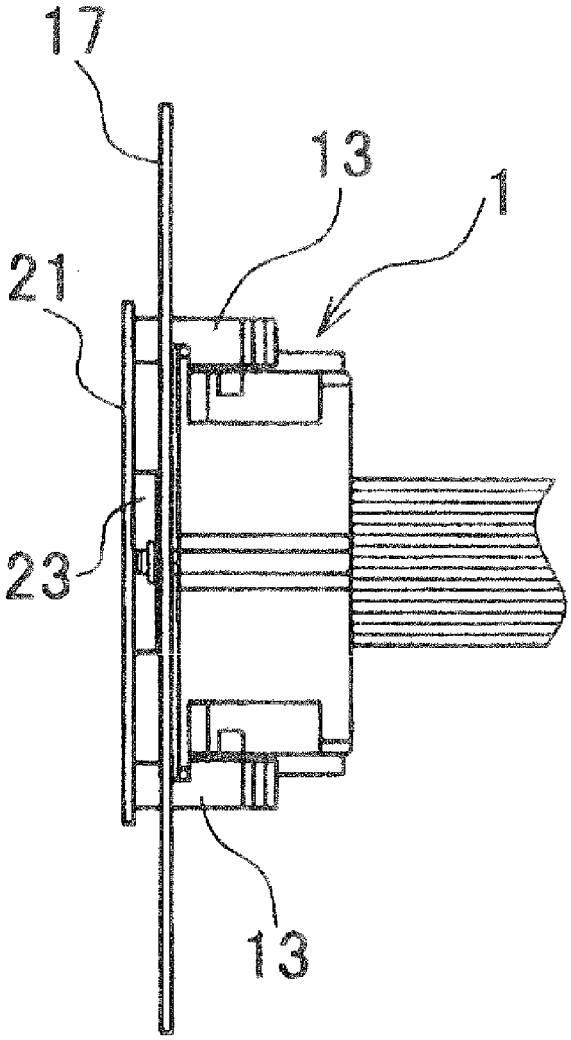
FIG. 8C is a side view of the same.
Figure 9:
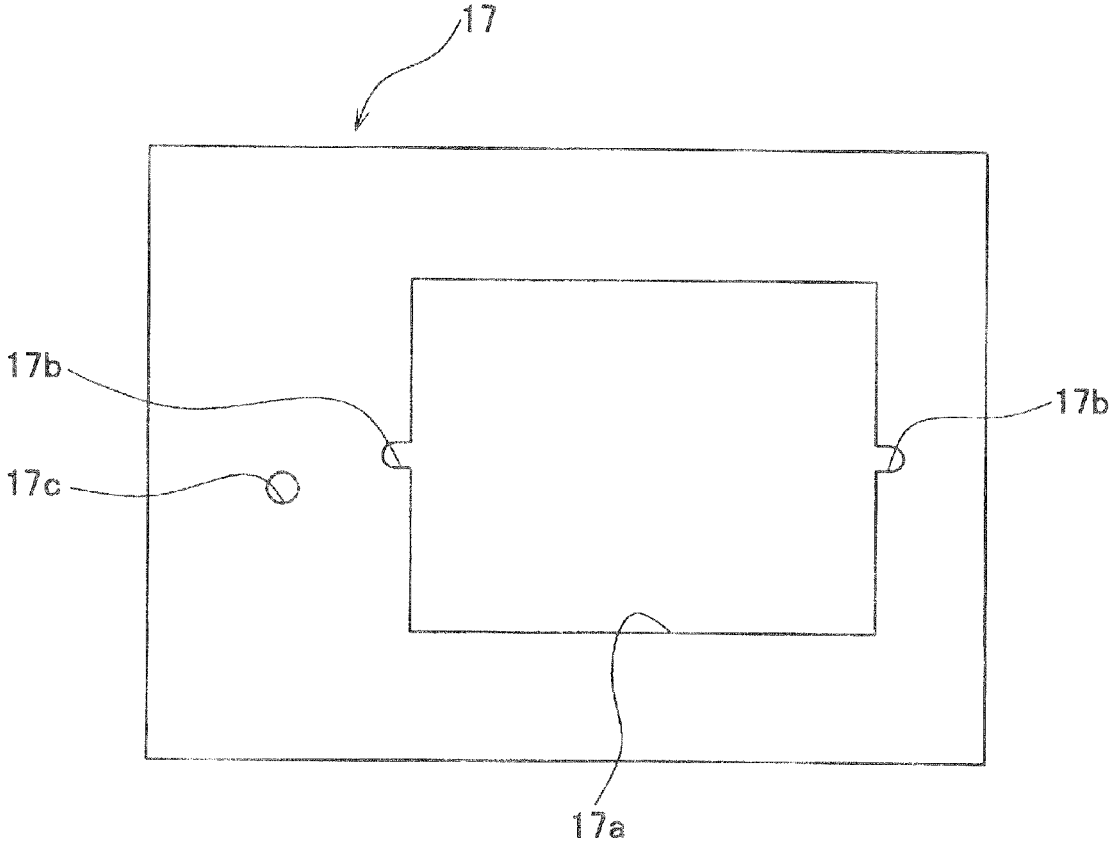
FIG. 9 is a plan view of a panel appearing in FIG. 7.

Referring first to FIG. 7, an object fitting/removing drive unit 1 is a unit for fitting/removing cable connectors (one object to be connected) 15 which are held by an inner frame 5 and header connectors (another object to be connected) 23 which are mounted on a substrate 21 to and from each other. The inner frame 5 is fixed to a panel 17 e.g. of a casing, not shown, of a super computer, not shown.

As shown in FIGS. 1, 2, 3, and 7, the object fitting/removing drive unit 1 is comprised of first and second operation members 3 and 3', the inner frame 5, a pair of sliders (outer frame) 7, a drive transfer device (drive transferring means) 9, a frame plate 11, and a pair of flanges 13.

Figure 4A:
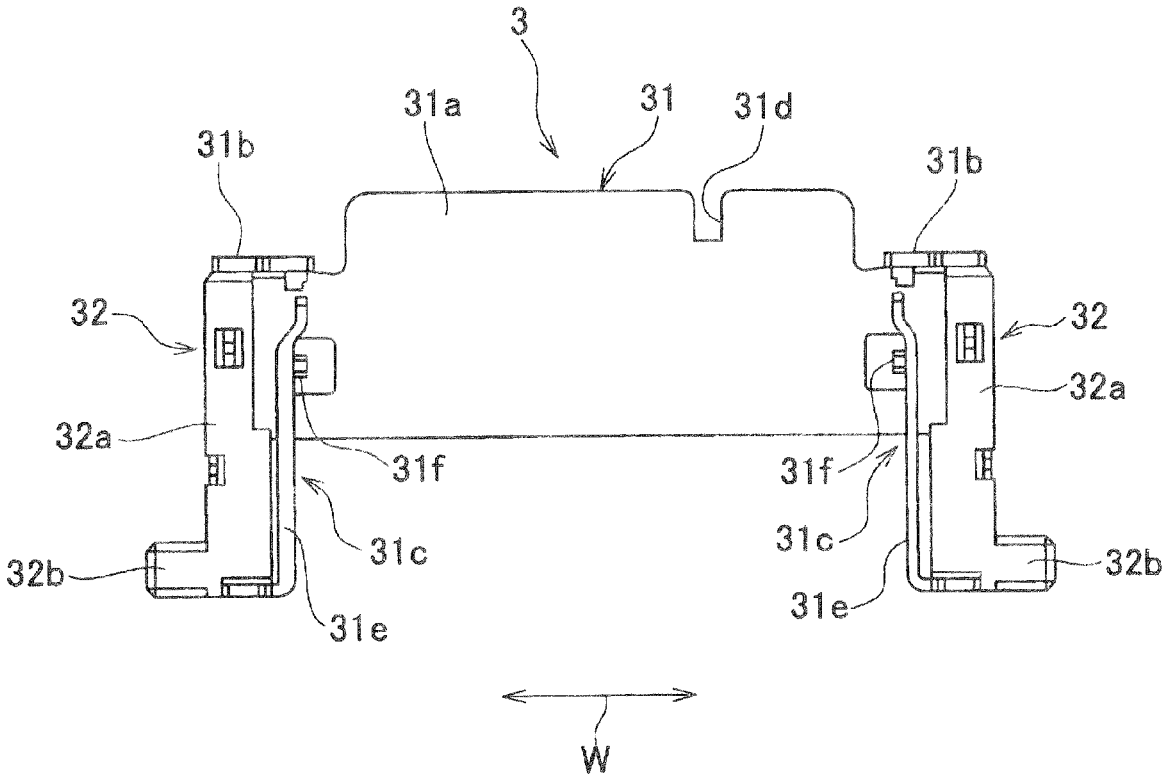
FIG. 4A is a front view of a first operation member of the object fitting/removing drive unit shown in FIG. 1.
Figure 4B:
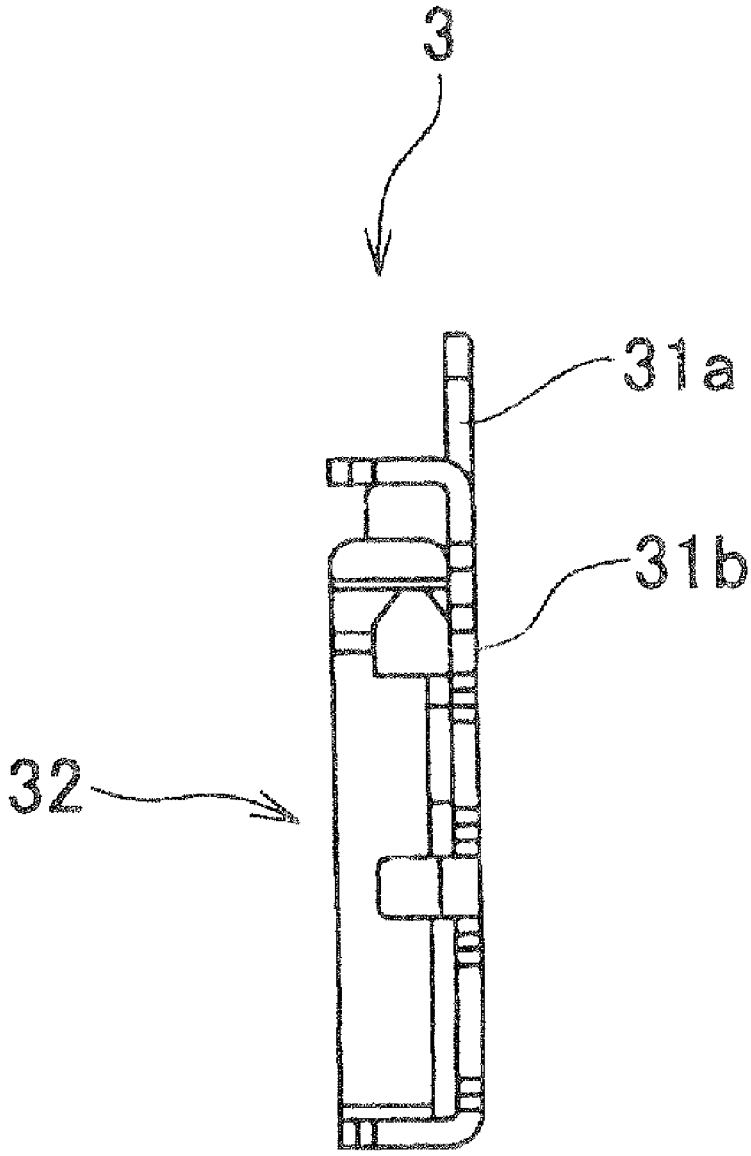
FIG. 4B is a side view of the first operation member.

As shown in FIGS. 4A and 4B, each of the first operation members 3 is formed by a holding frame 31 and a pair of mold bosses 32.

The holding frame 31 is formed by blanking and bending a metal plate. The holding frame 31 includes a plate portion 31*a*, a pair of fixing portions 31*b*, and a pair of locking portions 31*c*.

The plate portion 31*a* has an upper part formed with a cutout 31*d*. The cutout 31*d* is a mark that makes the first operation member 3 distinguishable from the second operation member 3'.

A pair of the fixing portions 31*b* are connected to opposite sides of the plate portion 31*a*, respectively. The mold bosses 32 are fixed to the fixing portions 31*b*, respectively.

A pair of locking portions 31*c* are opposed to each other in a direction of the width W of the cable connector 15 (see FIGS. 3 and 7) Each locking portion 31*c* is comprised of a spring portion 31*e* and a lug portion 31*f*. The spring portion 31*e* is connected to a lower end of the fixing portion 31*b*. The lug portion 31*f* is continuous with an upper portion of the spring portion 31*e*, and protrudes in the direction of the width W. A pair of the locking portions 31*c* locks and holds an associated cable connector 15 disposed therebetween in a sandwiching manner.

Each of the mold bosses 32 is made of a synthetic resin, and is engaged with the holding frame 31 by press-fitting. Each mold boss 32 includes a fixing portion 32*a* and a boss 32*b*. The fixing portion 32*a* is fixed to the fixing portion 31*b* of the holding frame 31. The boss 32*b* is continuous with the fixing portion 32*a*, and protrudes in the direction of the width W.

Figure 5A:
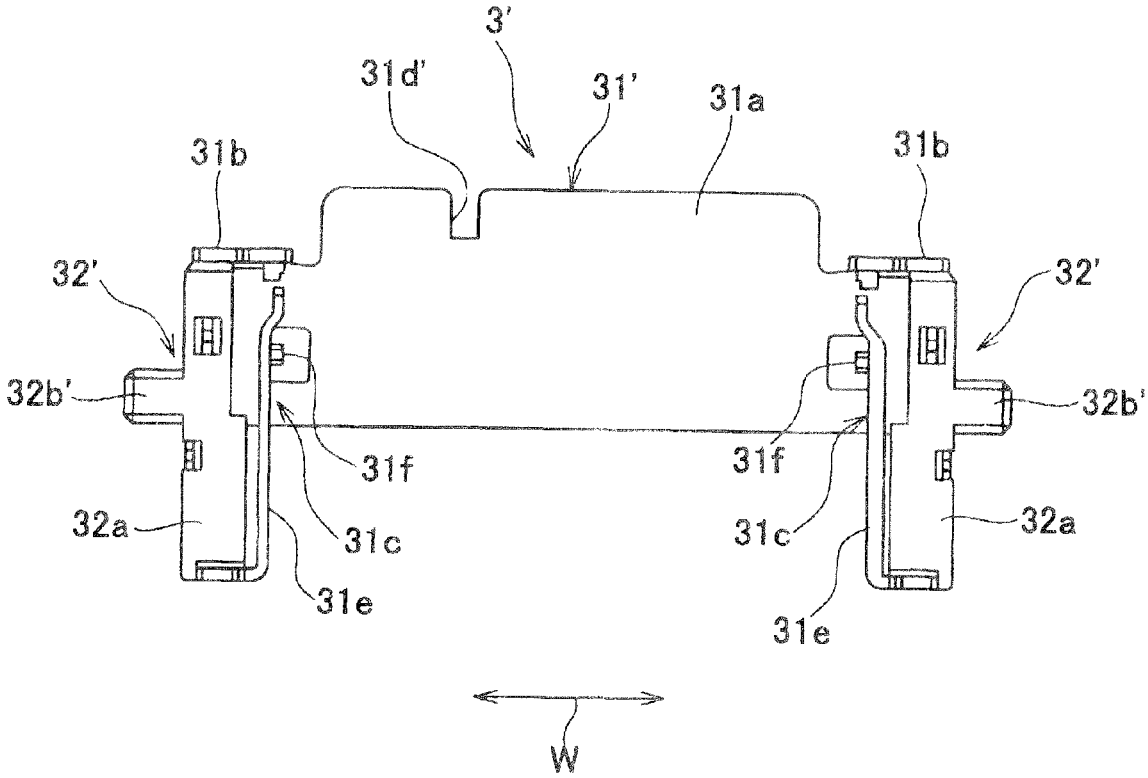
FIG. 5A is a front view of a second operation member of the object fitting/removing drive unit shown in FIG. 1.
Figure 5B:
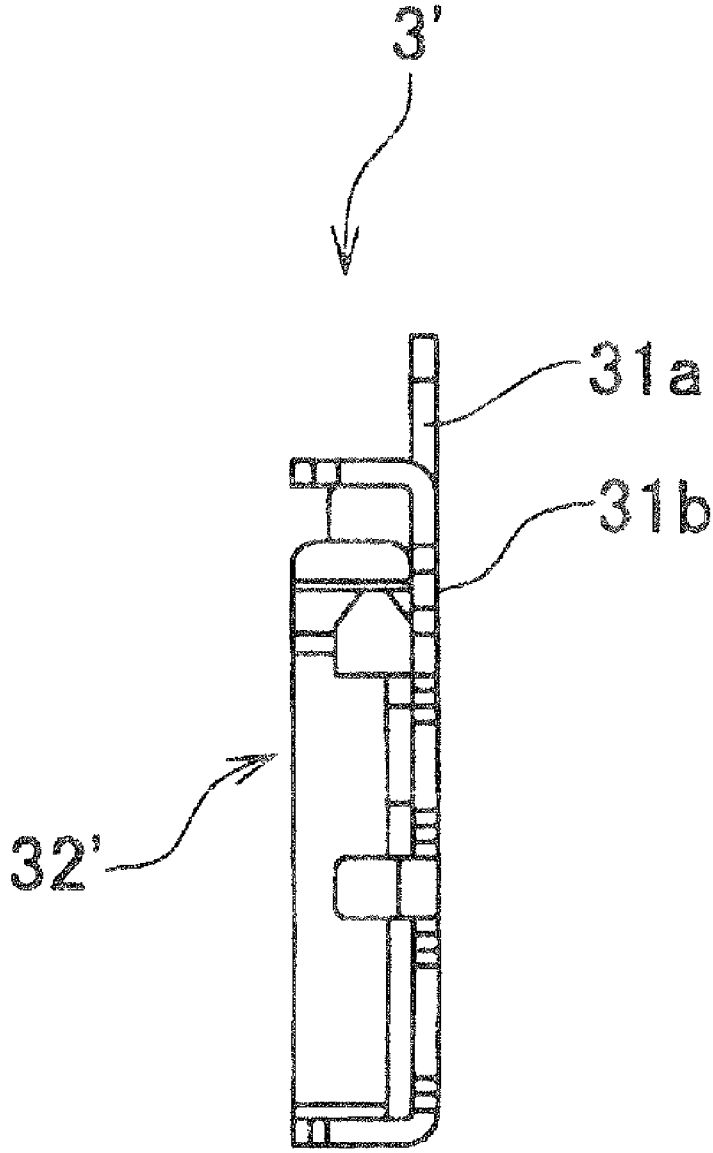
FIG. 5B is a side view of the second operation member.

As shown in FIGS. 5A and 5B, each of the second operation members 3' is comprised of a holding frame 31' and a pair of mold bosses 32'. There is no difference between the portions of the holding frame 31 and the portions of the holding frame 31' except that the position of a cutout 31*d'* of the holding frame 31' is different from the position of the cutout 31*d* of the holding frame 31. Therefore, the portions of the holding frame 31' are denoted by the same reference numerals as those for the corresponding portions of the holding frame 31, respectively, and description of the holding frame 31' is omitted. Similarly, there is no difference between the portions of each mold boss 32 and the portions of each mold boss 32' except that the position of a boss 32*b'* of the mold boss 32' is different from the position of the boss 32*b* of the mold boss 32. Therefore, the portions of the mold boss 32' are denoted by the same reference numerals as those for the corresponding portions of the mold boss 32 and description of the mold boss 32' is omitted.

Figure 2:
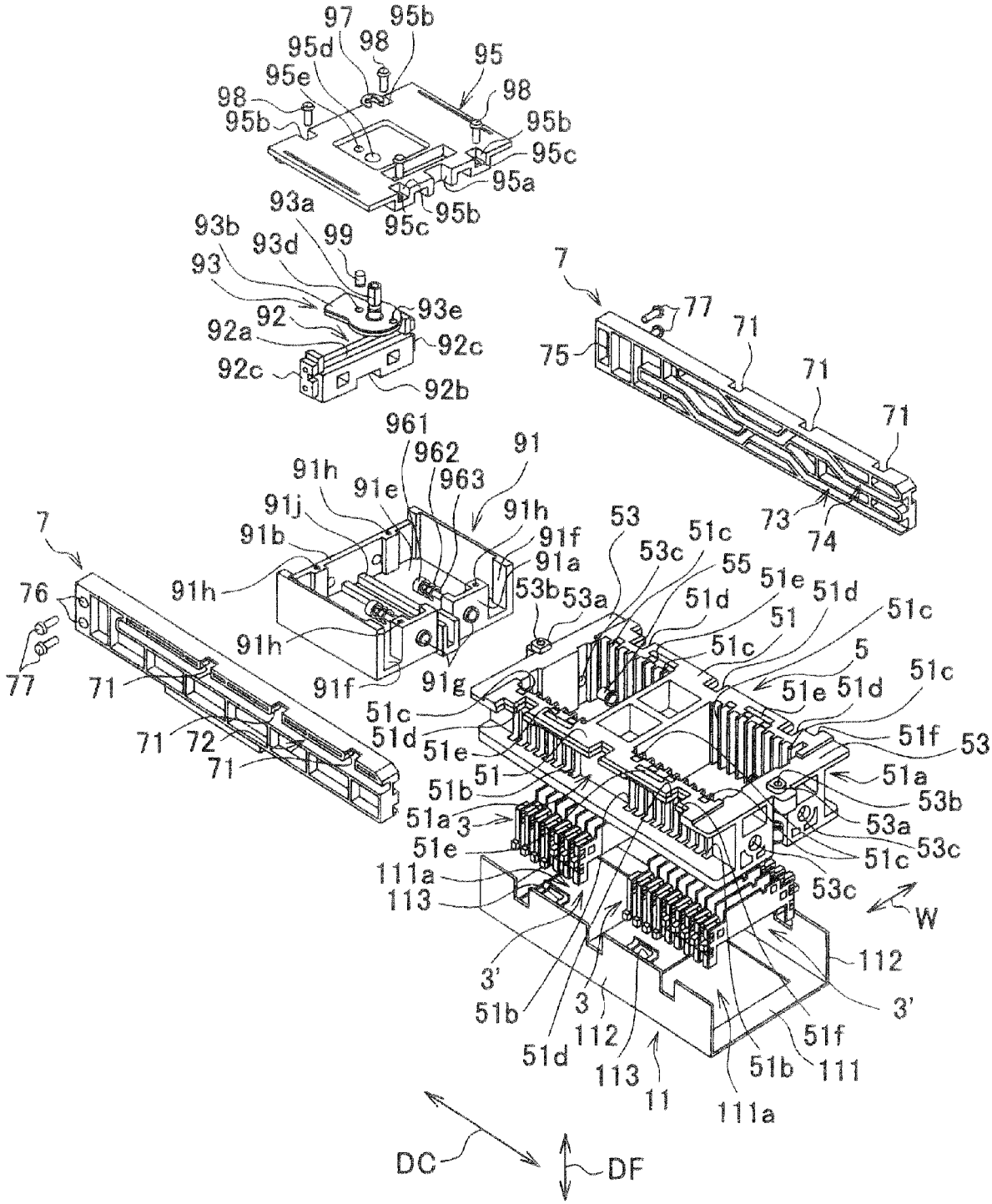
FIG. 2 is an exploded perspective view of the object fitting/removing drive unit shown in FIG. 1.

As shown in FIG. 2, the inner frame 5 is substantially frame-shaped, and is made of a synthetic resin. The inner frame 5 includes side walls 51, 51, 53, and 53.

Figure 3:
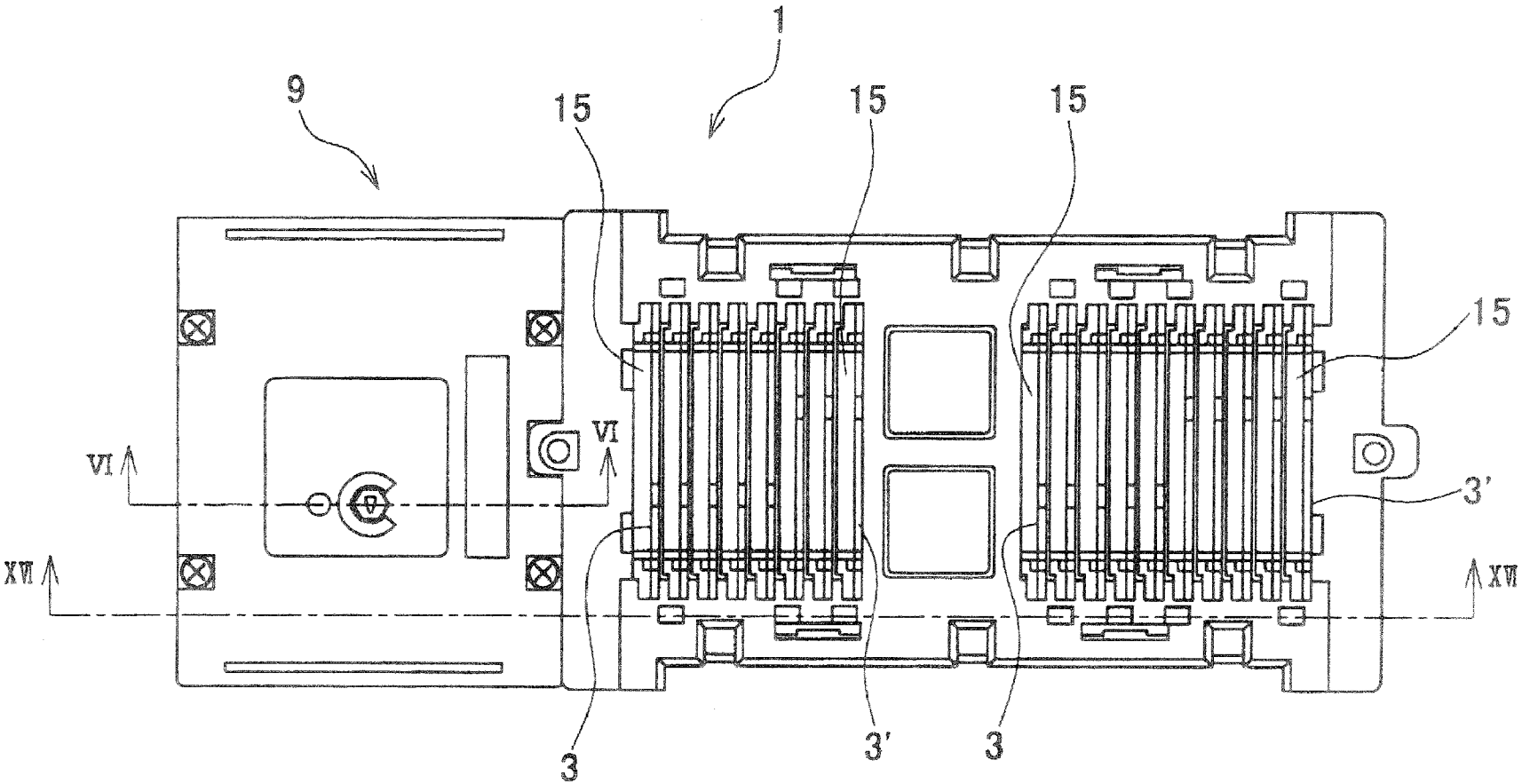
FIG. 3 is a plan view of the object fitting/removing drive unit shown in FIG. 1.

The side walls 51 and 51 extend along a connector arranging direction DC (direction which is orthogonal to a fitting/removing direction DF) of the cable connectors 15 (see FIGS. 3 and 7). The side walls 51 and 51 are parallel to each other. Each side wall 51 has an outer surface formed with a recess 51*a*. The recess 51*a* extends in the connector arranging direction DC. In the recess 51*a*, the slider 7 associated therewith is accommodated in a manner slidable in the connector arranging direction DC.

Each side wall 51 is formed with a plurality of guide slots 51*b* at equally-spaced intervals in the connector arranging direction DC, except a central portion thereof. The guide slots 51*b* are each formed from near an upper end to a lower end of the first side wall 51, and extend in the fitting/removing direction DF of the cable connector 15. The guide slots 51*b* are communicated with the recess 51*a*. The guide slots 51*b* guide the bosses 32*b* and 32*b*' of the mold bosses 32 and 32' in the fitting/removing direction DF. The bosses 32*b* and 32*b*' protrude into the accommodating recesses 51*a* via the guide slots 51*b*.

Each side wall 51 has an inner surface formed with a plurality of guide pieces 51*c* at equally-spaced intervals in the connector arranging direction DC, except the central portion thereof. The guide pieces 51*c* are each formed from the upper end to the lower end of the side wall 51, and extend in the fitting/removing direction DF of the cable connector 15. The guide pieces 51*c* are disposed at adjacent locations to the guide slots 51*b*, for guiding the operation members 3 and 3' in the fitting/removing direction DF.

Further, each side wall 51 has an upper surface formed with engaging holes 51*e*. Each engaging hole 51*e* is communicated with the accommodating recess 51*a*, and receives an engaging piece 113, referred to hereinafter, of the frame plate 11.

Further, the side walls 51 have upper surfaces having respective front-side and rear-side edges formed with cutouts 51*f* (first positioning portions) and each edge is formed with three cutouts 51*d* which are continuous with the cutouts 51*f* (see FIG. 2). The cutouts 51*f* extend in the connector arranging direction DC, and receive the flanges 13. By being received in the cutouts 51*f*, the flanges 13 are prevented from moving along the connector arranging direction DC and moving in a direction which is orthogonal to the fitting/removing direction DF and the connector arranging direction DC. The positions of the header connectors 23 with respect to the respective associated cable connectors 15 on an imaginary plane which is orthogonal to the fitting/removing direction DF is determined by the cutouts 51*f*. The cutouts 51*d* are communicated with the accommodating recesses 51*a*, for guiding pins 131, referred to hereinafter, of the flanges 13 into the accommodating recesses 51*a*.

As shown in FIG. 2, the side walls 53 and 53 extend in the direction which is orthogonal to the fitting/removing direction DF and the connector arranging direction DC. The side walls 53 and 53 are parallel to each other. The side walls 53 and 53 are continuous with the ends of the side walls 51 and 51.

Each side wall 53 has an upper surface formed with a protrusion 53*a*. The protrusion 53*a* is formed with a hole 53*b*. The dimension of the height of the protrusion 53*a* is larger than that of the thickness of the panel 17, referred to hereinafter (see FIG. 7).

Further, each side wall 53 is formed with holes 53*c*. An insert 55 is press-fitted in each hole 53*c*.

Figure 16:
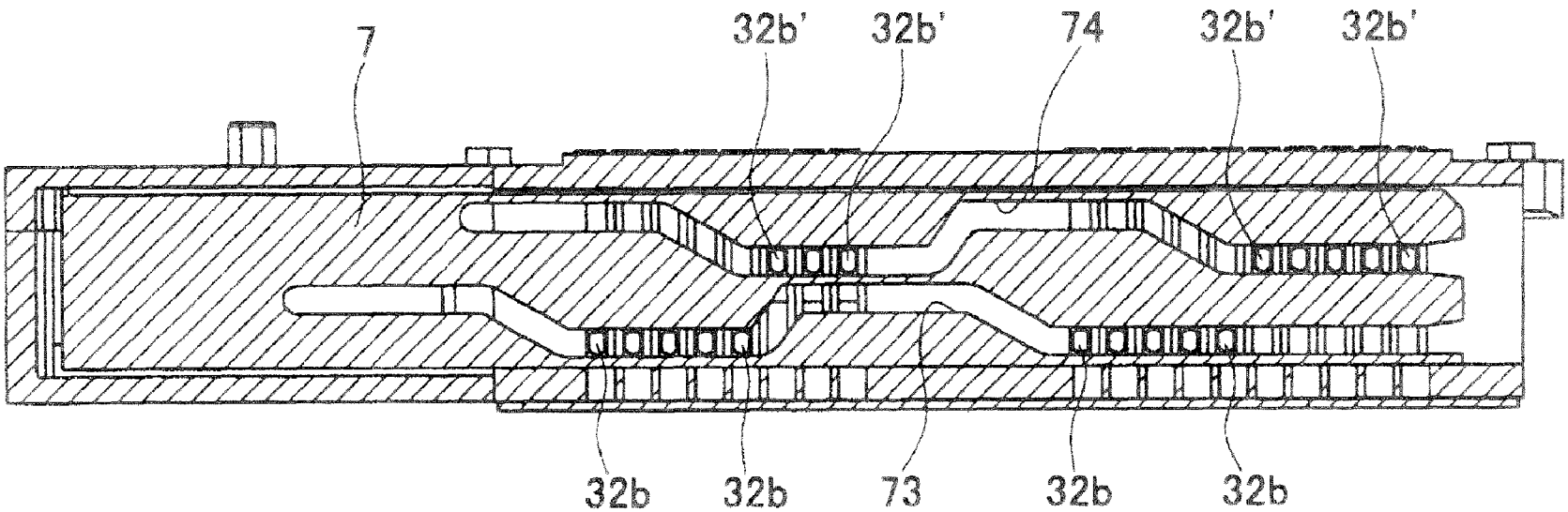
FIG. 16 is a cross-sectional view taken on line XVI-XVI of FIG. 3 when the slider is in the initial position.

As shown in FIG. 2, the pair of sliders 7 (outer frame) are accommodated in the accommodating recesses 51*a* of the inner frame 5 such that they can slide between an initial position (position (see FIG. 16) before the sliders 7 guide the holding members 3 and 3' toward the header connector 23 (see FIG. 7)) and a fitting-completed position (position (see FIG. 17) after the sliders 7 have caused all cable connectors 15 (see FIG. 7) to be fitted to the header connector 23 (see FIG. 7)).

Each slider 7 is substantially prism-shaped, and is made of a synthetic resin. The slider 7 has an upper surface formed with three cutouts (introducing cutouts) 71. When the sliders 7 are in the initial position, the cutouts 71 are opposed to the cutouts 51*d* of the inner frame 5 in the fitting/removing direction DF.

The slider 7 has an outer surface formed with an accommodating groove (positioning groove) 72. The accommodating groove 72 extends in the connector arranging direction DC, and is communicated with three cutouts 71, respectively. When the slider 7 is in the initial position, the accommodating groove 72 is communicated with the cutouts 51*d* via the cutouts 71, respectively. When the slider 7 is in the initial position, the pins 131 of the flanges 13 (see FIG. 7) are accommodated into the accommodating groove 72 via the cutouts 51*d* and 71. As the slider 7 is moved from the initial position to the fitting-completed position, the pins 131 are relatively moved in the connector arranging direction DC while being in contact with the inner walls of the accommodating groove 72. The width of the accommodating groove 72 is only slightly wider than the outer diameter of each pin 131, which prevents the pin 131 from moving in the fitting/removing direction DF. The above-described cutouts 71 and the accommodating groove 72 form a second positioning portion that determines the position of the header connectors 23 with respect to the cable connectors 15 in the fitting/removing direction DF.

The slider 7 has an inner surface formed with a first cam groove 73 and a second cam groove 74. The first cam groove 73 extends in the connector arranging direction DC, and is bent into a substantially crank shape. The bosses 32*b* (see FIG. 4A) of the first operation members 3 are slidably inserted in the first cam groove 73. The second cam groove 74 extends in the connector arranging direction DC, and is bent into a substantially crank shape. The second cam groove 74 is at a location upward of the first cam groove 73. The bosses 32*b*' of the second operation member 3' (see FIG. 5A) are slidably inserted in the second cam grooves 74. As described above, the first and second cam grooves 73 and 74 are formed in each slider 7 in two levels in the fitting/removing direction DF, which reduces the length and the sliding distance of each slider 7.

The slider 7 has one end formed with a recess 75. The recess 75 is formed with screw insertion holes 76.

Figure 1:
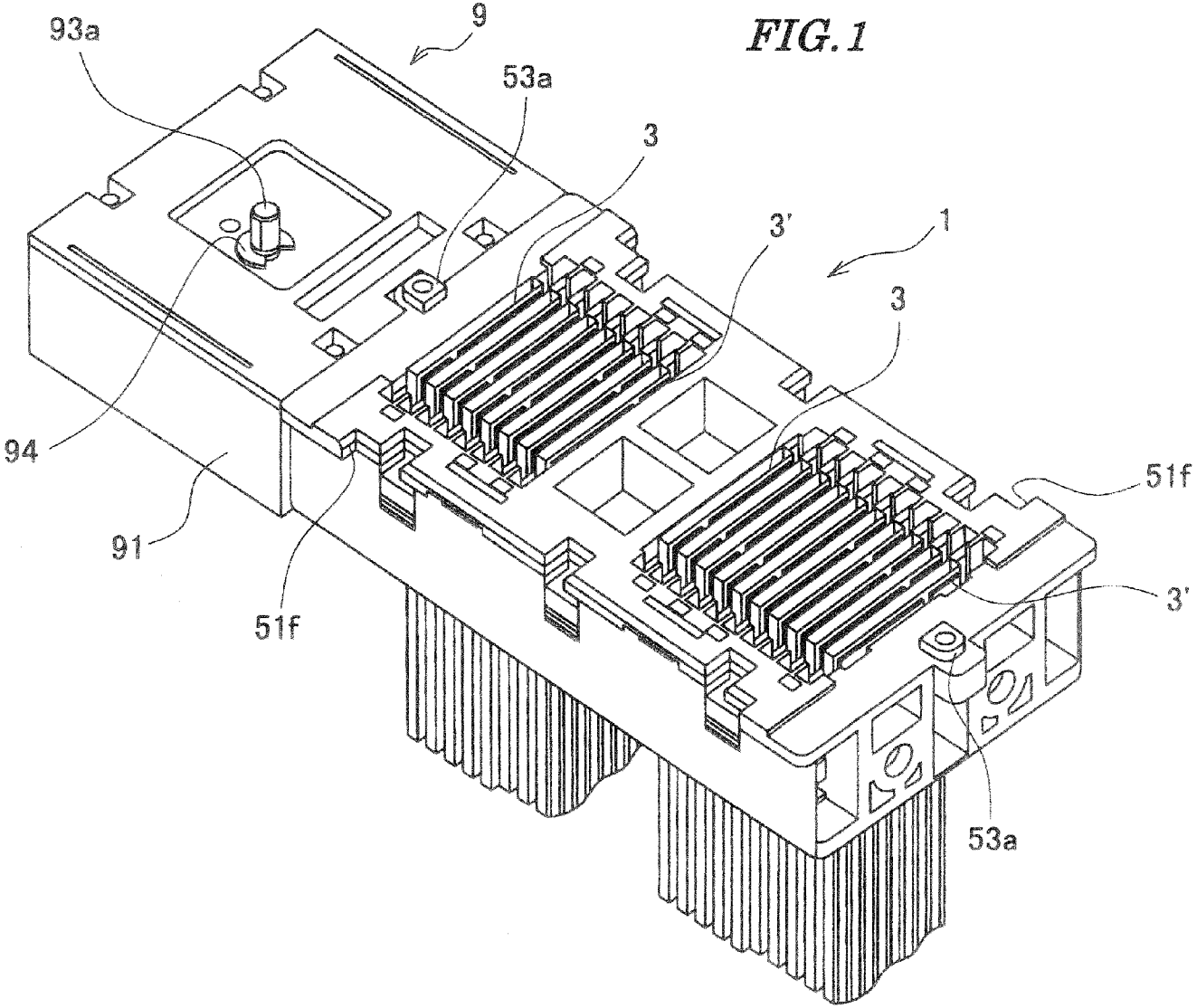
FIG. 1A is a perspective view of an object fitting/removing drive unit according to an embodiment of the present invention.

As shown in FIGS. 1 and 2, the drive transfer device 9 includes a casing 91, a connecting body 92, a cam 93, and a cover 95.

The casing 91 has a side wall 91*a* formed with two cutouts 91*f*. One end of each slider 7 is inserted into the casing 91 via the associated one of the cutouts 91*f*

Further, the side wall 91*a* is formed with two holes 91*g*. A hexagon socket head bolt 961 on which a plain washer 962 and a spring 963 are mounted is screwed into each of the inserts 55 which are press-fitted in the holes 53*c* of the side walls 53 of the inner frame 5, via each of the holes 91*g*. Thus, the casing 91 is fixed to the inner frame 5.

A top of the side wall 91*a* and a top of a side wall 91*b* which is opposed to the side wall 91*a* with spacing has holes 91*h* formed therein for tap screws 98.

The casing 91 has a bottom board 91*e* formed with a rail 91*j*. The rail 91*j* extends in the connector arranging direction DC.

The connecting body 92 is substantially plate-shaped. The connecting body 92 has a top formed with a groove 92*a*. The longitudinal direction of the groove 92*a* is orthogonal to the fitting/removing direction DF and the connector arranging direction DC. The connecting body 92 is disposed in the casing 91 in a manner movable in the connector arranging direction DC. The connecting body 92 has a bottom formed with a recess 92*b*. The recess 92*b* is fitted on the rail 91*j*, and the connecting body 92 is guided in the connector arranging direction DC by the rail 91*j*. The connecting body 92 has opposite sides formed with protrusions 92*c*. The protrusions 92*c* are fitted in the recesses 75 of the sliders 7 inserted in the casing 91. The sliders 7 are connected to the connecting body 92 by tap screws 77 which are inserted in the screw insertion holes 76 of the sliders 7.

Figure 6:
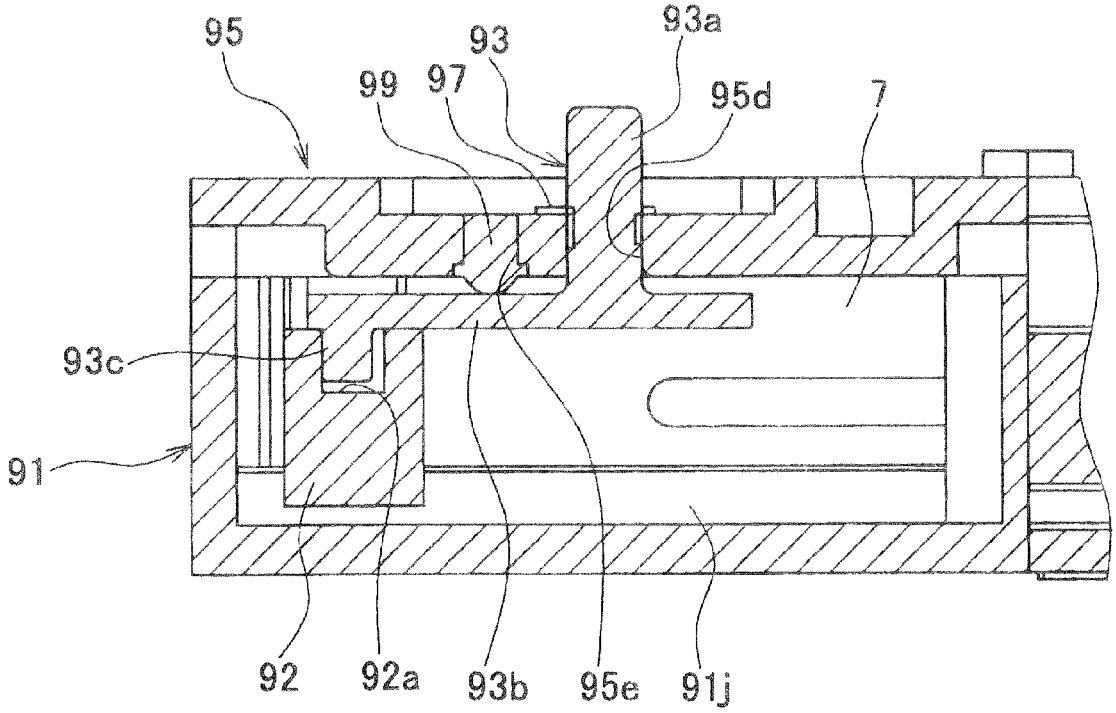
FIG. 6 is a cross-sectional view taken on line VI-VI of FIG. 3.

As shown in FIG. 6, the cam 93 includes an operation shaft 93*a*, a plate 93*b*, and a pin 93*c*. The operation shaft 93*a* is inserted in a hole 95*d*, referred to hereinafter, of the cover 95, and an E ring 97 is mounted thereon. The operation shaft 93*a* is rotatable with respect to the cover 95.

The plate 93*b* is substantially keyhole-shaped, in plan view. The plate 93*b* is fixed to the lower end of the operation shaft 93*a*. The plate 93*b* has an upper surface formed with recesses 93*d* and 93*e* (see FIG. 2).

The pin 93*c* is fixed to the lower surface of a foremost end (end toward where the recess 93*d* is formed) of the plate 93*b*. The pin 93*c* is movably inserted in the groove 92*a* of the connecting body 92.

The cover 95 covers the top of the casing 91. As shown in FIG. 2, the cover 95 is formed with a recess 95*a*. The recess 95*a* accommodates the protrusion 53*a* of the inner frame 5.

Further, the cover 95 is formed with four recesses 95*b*. Each recess 95*b* is formed with a hole 95*c*. The cover 95 is fixed to the casing 91 by the tap screws 98 which are inserted in the holes 91*h* of the casing 91 via the holes 95*c*.

Further, the cover 95 is formed with the hole 95*d*. The operation shaft 93*a* of the cam 93 extends through the hole 95*d*.

Furthermore, the cover 95 is formed with a hole 95*e*. A press-fit plunger 99 is accommodated in the hole 95*e* (see FIG. 6). A lower end of the press-fit plunger 99 has an outer diameter larger than the other portions of the press-fit plunger 99, which prevents the press-fit plunger 99 accommodated in the hole 95*e* from being removed upward of the cover 95.

As shown in FIG. 2, the frame plate 11 covers the front surface, the rear surface, and the bottom surface of the inner frame 5. The frame plate 11 is formed by blanking and bending a metal plate, and includes a board 111 at the bottom and two boards 112 at the front and rear. The board 111 is formed with two window holes 111*a*. The boards 112 are continuous with the opposite sides of the board 111. Engaging pieces 113 are continuous with the tops of the boards 112. Each engaging piece 113 is substantially U-shaped, and has a foremost end bent upward at a right angle. The foremost end of the engaging piece 113 is inserted into the associated engaging hole 51*e* of the inner frame 5 from bottom, and is hooked on a protrusion (not shown) which is formed on the inner surface of the engaging hole 51*e*. Thus, the frame plate 11 is fixed to the inner frame 5. When the frame plate 11 is fixed to the inner frame 5, the lower ends of the guide slots 51*b* of the inner frame 5 are covered with the periphery of the window holes 111*a* of the board 111, which prevents the bosses 32*b* and 32*b*' of the mold bosses 32 and 32' of the operation members 3 and 3' from being removed from the guide slots 51*b*. Further, the accommodating recesses 51*a* of the inner frame 5 are covered with the boards 112, which blocks the sliders 7 from moving in the width direction W of the inner frame 5.

As shown in FIGS. 7, 8A, 8B, 8C, and 9, the inner frame 5 is fixed to the panel 17. The panel 17 includes a window hole 17*a*, cutouts 17*b*, and a hole 17*c*. The window hole 17*a* causes the operation members 3 and 3' to be exposed. The cutouts 17*b* accommodate the protrusions 53*a* of the inner frame 5. The operation shaft 93*a* extends through the hole 17*c*.

The inner frame 5 is fixed to the panel 17 by fitting the protrusions 53*a* of the inner frame 5 in the cutouts 17*b* of the panel 17, and screwing a washer built-in screw 19 which includes a washer having an outer diameter larger than the width dimension of the cutout 17*b* into each of the holes 53*b*. The height dimension of each protrusion 53*a* is larger than the thickness dimension of the panel 17, which causes the inner frame 5 to be fixed to the panel 17 in a floating state.

Figure 10A:
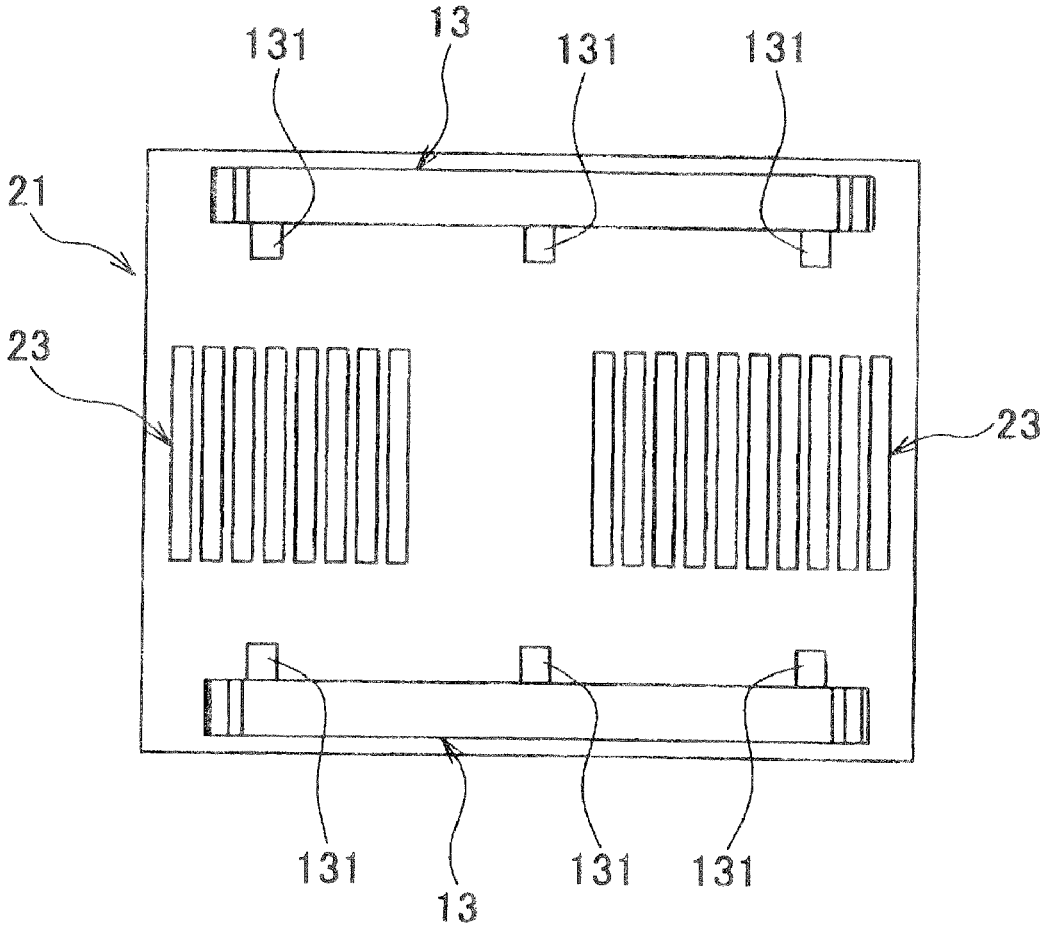
FIG. 10A is a plan view of the substrate on which the flange of the object fitting/removing drive unit shown in FIG. 1 is fixed.
Figure 10B:
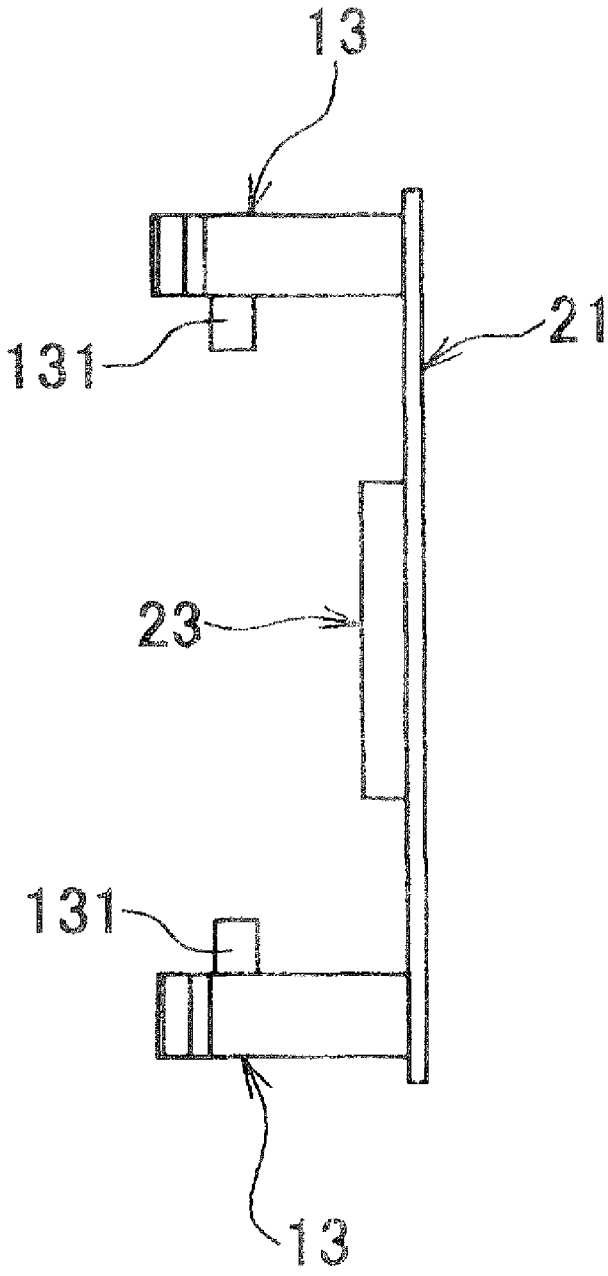
FIG. 10B is a side view of the substrate on which the flange of the flange is fixed.
Figure 11:
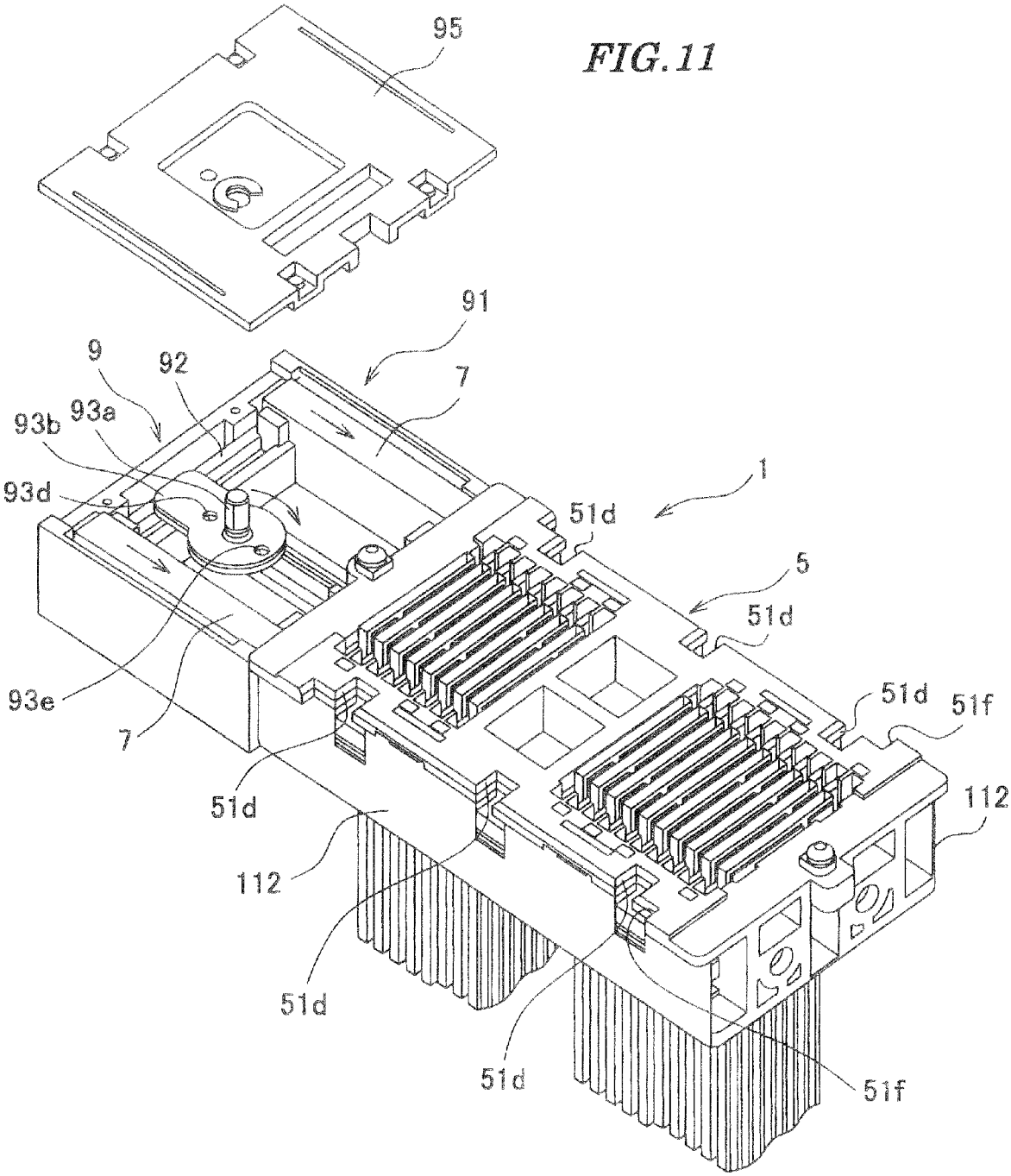
FIG. 11 is a perspective view of the object fitting/removing drive unit in a state in which a cover is removed.
Figure 12:
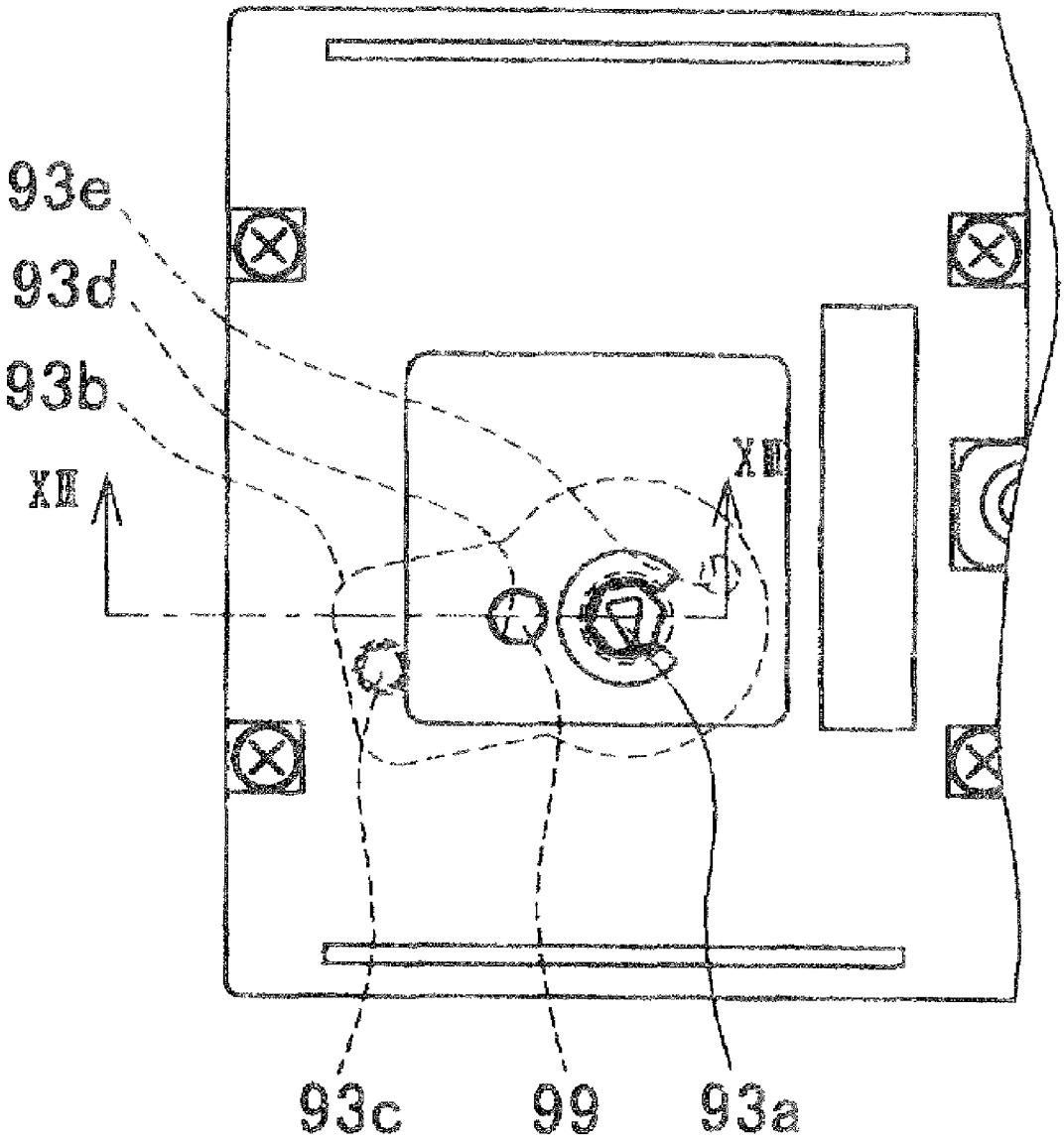
FIG. 12 is a plan view of part of a drive transfer device when a slider is in an initial position.
Figure 13:
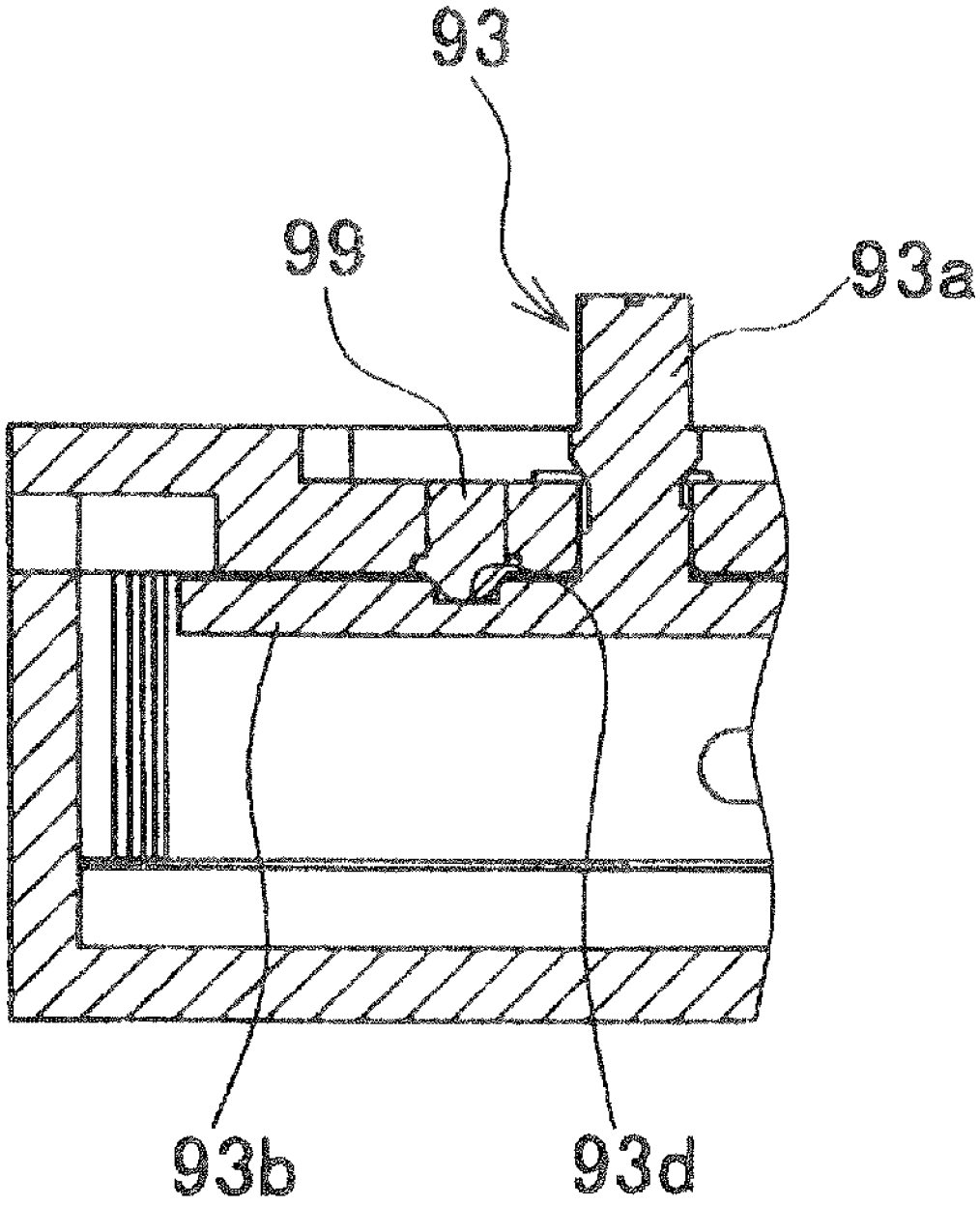
FIG. 13 is a cross-sectional view taken on line XIII-XIII of FIG. 12.

As shown in FIGS. 10A and 10B, the pair of flanges 13 and 13 are disposed on (connected to) the substrate 21 in parallel with spacing therebetween.

Each flange 13 is substantially plate-shaped. The three pins 131 are formed on the inner surface the flange 13.

The header connectors 23 which are mating connectors of the cable connectors 15 are mounted on the substrate 21.

Nest, a description will be given of operations of the object fitting/removing drive unit 1.

As shown in FIGS. 11, 12, 13, and 16, when the sliders 7 are in the initial position, the foremost end of the press-fit plunger 99 is slightly fitted in the recess 93*d* of the plate 93*b* of the drive transfer device 9, which temporarily fixes the cam 93 in the initial position. If the operation shaft 93*a* of the cam 93 is pivoted in a clockwise direction as viewed in the figure by a nut driver (not shown) from this state (see FIG. 11), the plate 93*b* is pivoted and at the same time the pin 93*c* urges the connecting body 92 (see FIG. 6), whereby the connecting body 92 is moved toward the inner frame 5.

Figure 14:
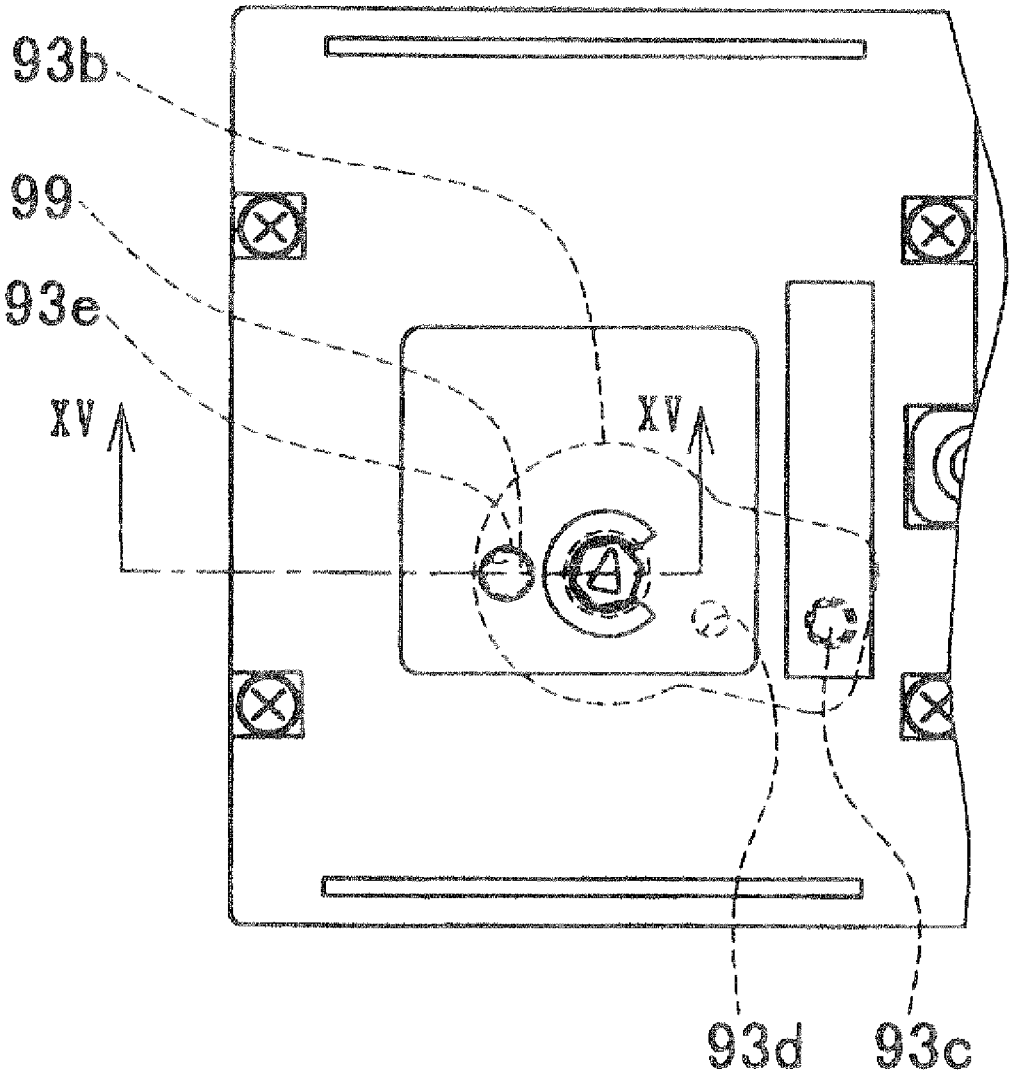
FIG. 14 is a plan view of part of the drive transfer device when the slider is in a fitting-completed position.
Figure 15:
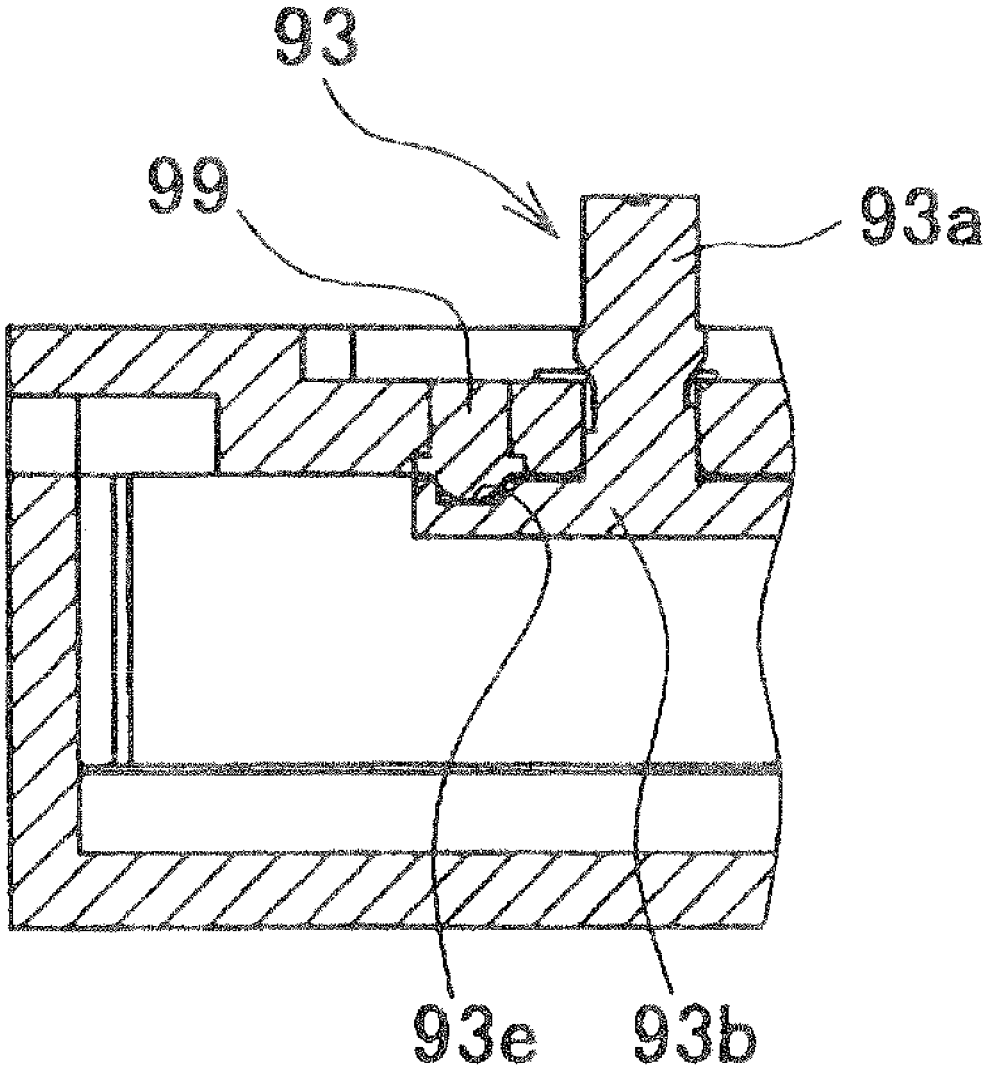
FIG. 15 is a cross-sectional view taken on line XV-XV of FIG. 14.
Figure 17:
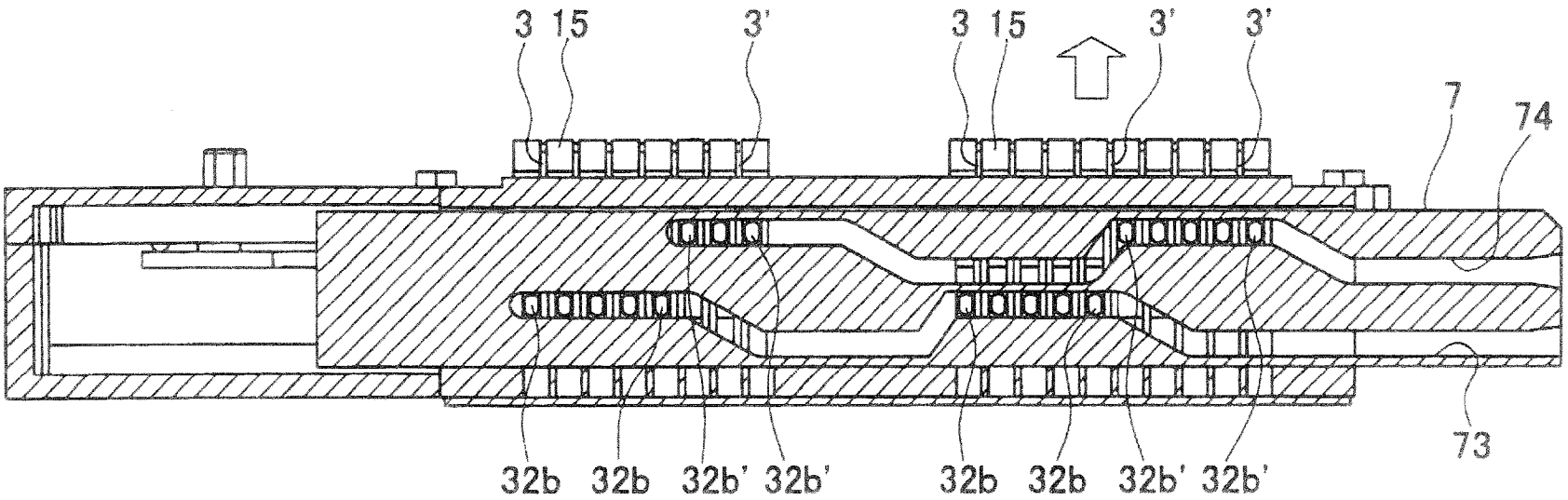
FIG. 17 is a cross-sectional view taken on line XVI-XVI of FIG. 3 when the slider is in the fitting-completed position.

As shown in FIGS. 14 and 15, if the operation shaft 93*a* is pivoted in the clockwise direction until the operation shaft 93*a* is stopped, the pin 93*c* moves the connecting body 92 to the vicinity of the inner frame 5. This movement of the connecting body 92 causes the sliders 7 to be moved to the fitting-completed position, as shown in FIG. 17.

When the sliders 7 are moved to the fitting-completed position, the press-fit plunger 99 is slightly fitted in the recess 93*e* of the plate 93*b*, whereby the cam 93 is temporarily fixed in the fitting-completed position.

As the sliders 7 are moved from the initial position to the fitting-completed position (see FIGS. 16 and 17), the first cam groove 73 of each slider 7 guides the bosses 32*b* of the first holding members 3 and the second cam groove 74 of each slider 7 guides the bosses 32*b*' of the second holding members 3' toward the header connector 23, respectively. At this time, the holding members 3 and 3' are moved toward the header connector 23, whereby the cable connector 15 is fitted to the header connector 23.

Figure 18:
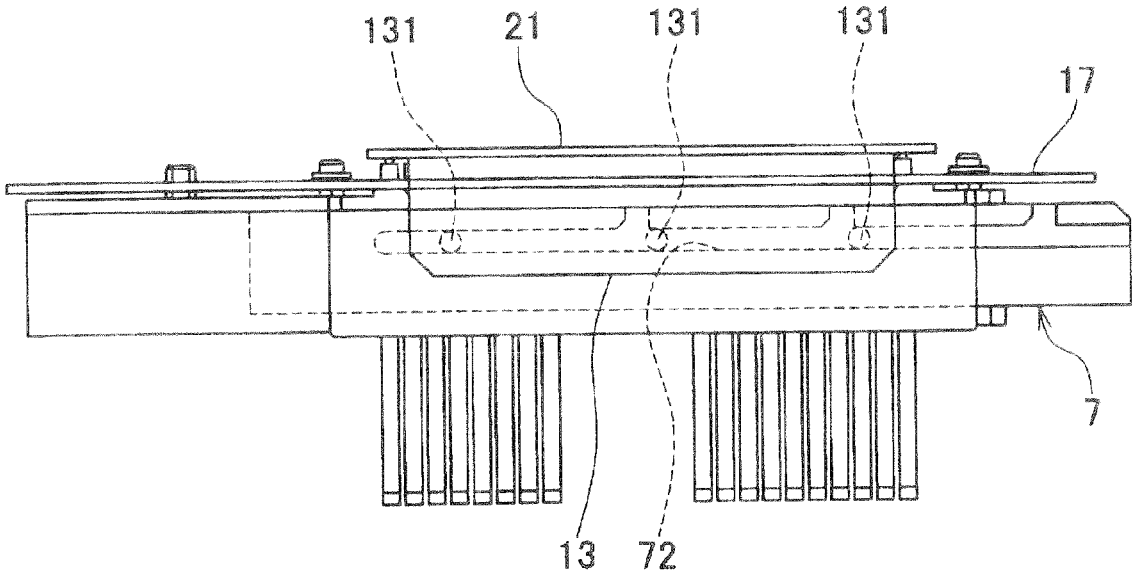
FIG. 18 is a front view of the object fitting/removing drive unit when the slider is in the fitting-completed position.

Further, as the sliders 7 are moved from the initial position to the fitting-completed position, the pins 131 of each flange 13 are relatively moved over a predetermined distance within the accommodating groove 72 of each slider 7. As shown in FIG. 18, when moved over the predetermined distance, the pins 131 are sandwiched by the inner surfaces of the accommodating grooves 72 in the fitting/removing direction DF, and hence the flanges 13 are in a state incapable of being moved in the fitting/removing direction DF, which determines the position of the header connectors 23 in the fitting/removing direction DF.

To remove the cable connector 15 from the header connector 23, it is only required to pivot the operation shaft 93*a* from the state illustrated in FIG. 4, in an anticlockwise direction using the nut driver.

Figure 19:
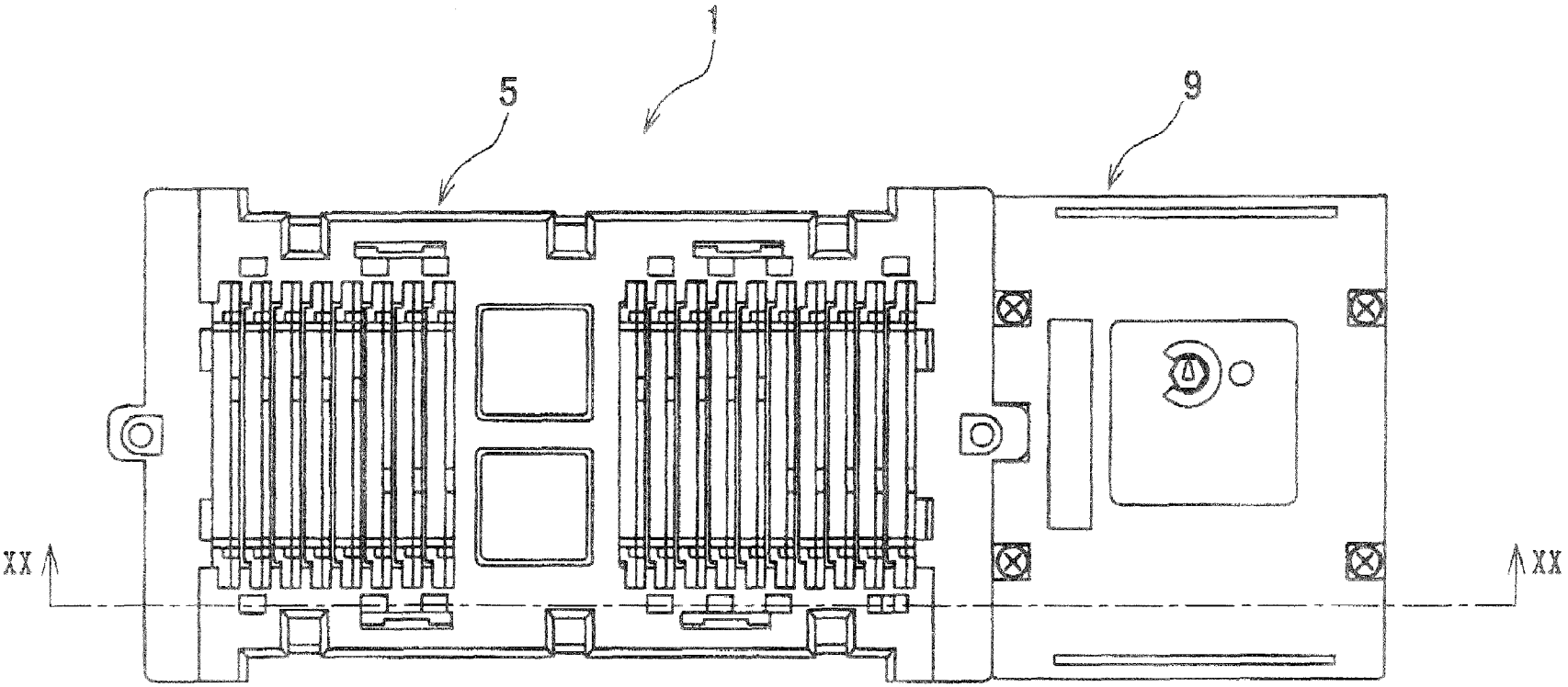
FIG. 19 is a front view of a variation of the object fitting/removing drive unit which is changed in the location of the drive transfer device.

Next, a variation of the present embodiment will be described. The variation of the object fitting/removing drive unit 1 shown in FIG. 19 is different from the object fitting/ removing drive unit 1 shown in FIG. 1 in that the drive transfer device 9 is disposed at an opposite location.

Figure 20:
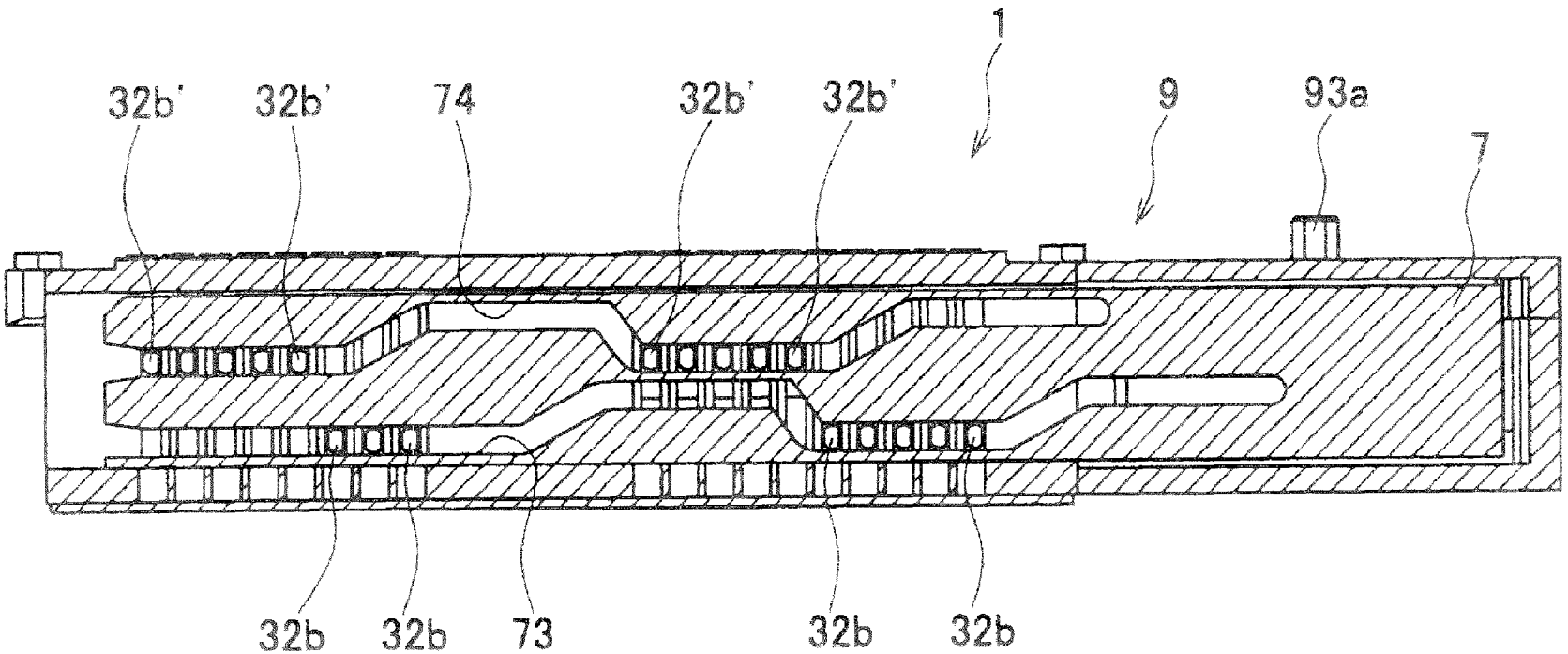
FIG. 20 is a cross-sectional view taken on line XX-XX of FIG. 19 when the slider is in the initial position.
Figure 21:
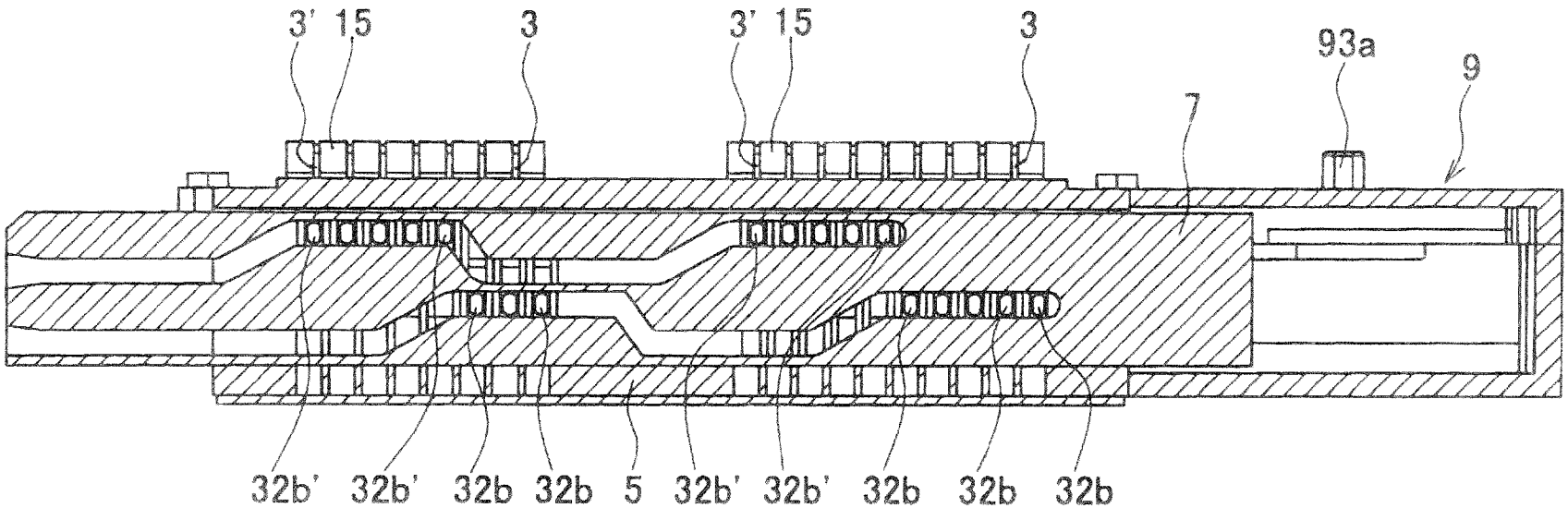
FIG. 21 is a cross-sectional view taken on line XX-XX of FIG. 19 when the slider is in the fitting-completed position.

Since the driving direction of the sliders 7 is also opposite, as shown in FIGS. 20 and 21, it is necessary to change the locations of the first operation member 3 and the second operation member 3'.

As described above, according to the object fitting/removing drive unit 1 of this embodiment, it is possible to accurately determine the position of the flanges 13 on the virtual plane which is orthogonal to the fitting/removing direction DF with respect to the inner frame 5, using the cutouts 51*f* of the inner frame 5 directly without the panel 17 of the casing. As a consequence, it is possible to accurately determine the position of the header connectors 23 on the virtual plane which is orthogonal to the fitting/removing direction DF with respect to the cable connector 15.

Further, it is possible to determine the position of the flanges 13 in the fitting/removing direction DF by the accommodating grooves 72 of the sliders 7. That is, in the present embodiment, the connectors are not positioned in the fitting/removing direction via a panel as in the conventional connector drive unit, but they are positioned and fitted without a panel. This increases the accuracy of fitting of the header connector 23 and the cable connector 15.

Further, since it is possible to operate the operation shaft 93*a* using a nut driver, it is not necessary to use special tools for operating the operation shaft 93*a*.

Furthermore, since it is possible to change the location of the drive transfer device 9, it is possible to dispose the operation shaft 93*a* at a location easy to operate.

Although the object fitting/removing drive unit 1 according to the above-described embodiment is used for fitting/removing the connectors to and from each other, the object fitting/removing drive unit according to the present invention can also be used for fitting/removing other objects to be connected than connectors.

It should be noted that the object fitting/removing drive unit 1, the cable connector 15, and the header connector 21 form a connector unit.

It is further understood by those skilled in the art that the foregoing are the preferred embodiments of the present invention, and that various changes and modification may be made thereto without departing from the spirit and scope thereof.

What is claimed is:

1. An object fitting/removing drive unit for fitting and removing a plurality of first objects to and from a plurality of second objects, which are to be connected to each other in a respective manner, comprising:

a plurality of operation members each including a holding frame, wherein each of the holding frames holds a respective one of the first objects to be connected;

an inner frame which accommodates said operation members in a manner movable in a fitting/removing direction, wherein said inner frame includes a plurality of first positioning portions which determine a position of the second objects to be connected, on an imaginary plane which is orthogonal to the fitting/removing direction, with respect to the first objects to be connected;

a pair of outer frames which are respectively mounted on side surfaces of said inner frame in a manner movable along a direction which is orthogonal to the fitting/removing direction between an initial position and a fitting-completed position, for guiding said operation members one by one toward the second objects to be connected to fit the first objects one by one to the second objects, when said pair of outer frames are moved from the initial position to the fitting-completed position;

driving force-transferring means for transferring a driving force in the direction which is orthogonal to the fitting/removing direction, to said pair of outer frames; and a pair of flanges which are connected to the plurality of second objects to be connected, and which are fitted to said inner frame.

2. An object fitting/removing drive unit as claimed in claim 1, wherein each of said first positioning portions comprises a cutout for positioning.

3. An object fitting/removing drive unit as claimed in claim 1, wherein each of said pair of outer frames includes a plurality of second positioning portions which determine a position of the second objects to be connected in the fitting/removing direction with respect to the first objects to be connected.

4. An object fitting/removing drive unit as claimed in claim 2, wherein each of said pair of outer frames includes a plurality of second positioning portions which determine a position of the second objects to be connected in the fitting/removing direction with respect to the first objects to be connected.

5. An object fitting/removing drive unit as claimed in claim 3, wherein each of said second positioning portions comprises a positioning groove which extends in the direction which is orthogonal to the fitting/removing direction, and guiding cutouts for guiding a protrusion which is provided on each of said pair of flanges to said positioning groove.

6. An object fitting/removing drive unit as claimed in claim 4, wherein each of said second positioning portions comprises a positioning groove which extends in the direction which is orthogonal to the fitting/removing direction, and guiding cutouts for guiding a protrusion which is provided on each of said pair of flanges to said positioning groove.

7. A connector unit having a plurality of first connectors, a plurality of second connectors which are capable of being fitted to the first connectors, and an object fitting/removing drive unit for fitting/removing the first connectors and the second connectors, the connector unit comprising:

a plurality of operation members each including a holding frame, wherein each holding frame holds a respective one of the first connectors;

an inner frame which accommodates said operation members in a manner movable in a fitting/removing direction, wherein said inner frame includes a plurality of first positioning portions which determine a position of the second connectors, on an imaginary plane which is orthogonal to the fitting/removing direction, with respect to the first connectors;

a pair of outer frames which are respectively mounted on side surfaces of said inner frame in a manner movable along a direction which is orthogonal to the fitting/removing direction between an initial position and a fitting-completed position, for guiding said operation members one by one toward the second connectors to fit the first connectors one by one to the second connectors, when said pair of outer frames are moved from the initial position to the fitting-completed position;

driving force-transferring means for transferring a driving force in the direction which is orthogonal to the fitting/removing direction, to said pair of outer frames; and a pair of flanges which are connected to the plurality of second connectors, and which are fitted to said inner frame.

8. A connector unit as claimed in claim 7, wherein each of said first positioning portions comprises a cutout for positioning.

9. A connector unit as claimed in claim 7, wherein each of said pair of outer frames includes a plurality of second positioning portions which determine a position of the second connectors in the fitting/removing direction with respect to the first connectors.

10. A connector unit as claimed in claim 8, wherein each of said pair of outer frames includes a plurality of second positioning portions which determine a position of the second connectors in the fitting/removing direction with respect to the first connectors.

11. A connector unit as claimed in claim 9, wherein each of said second positioning portions comprises a positioning groove which extends in the direction which is orthogonal to the fitting/removing direction, and guiding cutouts for guiding a protrusion which is provided on each of said pair of flanges to said positioning groove.

12. A connector unit as claimed in claim 10, wherein each of said second positioning portions comprises a positioning groove which extends in the direction which is orthogonal to the fitting/removing direction, and guiding cutouts for guiding a protrusion which is provided on each of said pair of flanges to said positioning groove.

* * * * *